US006922542B2

(12) United States Patent
Mizuno et al.

(10) Patent No.: US 6,922,542 B2
(45) Date of Patent: Jul. 26, 2005

(54) IMAGE FORMING APPARATUS

(75) Inventors: Tsuneo Mizuno, Kawasaki (JP); Hiroki Ohta, Kawasaki (JP); Atsushi Tano, Kawasaki (JP); Hiroki Ushiroda, Yokohama (JP)

(73) Assignee: Fuji 'Xerox Co., Ltd., Tokyo (JP)

( * ) Notice: Subject to any disclaimer, the term of this patent is extended or adjusted under 35 U.S.C. 154(b) by 180 days.

(21) Appl. No.: 10/611,809

(22) Filed: Jul. 2, 2003

(65) Prior Publication Data

US 2005/0058473 A1 Mar. 17, 2005

Related U.S. Application Data

(63) Continuation of application No. PCT/JP01/00165, filed on Jan. 12, 2001.

(51) Int. Cl.[7] ..... G03G 15/01
(52) U.S. Cl. ..... 399/302; 399/66; 399/308
(58) Field of Search ..... 399/38, 66, 297, 399/298, 299, 300, 301, 302, 308

(56) References Cited

U.S. PATENT DOCUMENTS 5,832,351 A 11/1998 Takekoshi et al.
5,893,022 A 4/1999 Yoshino et al.
6,324,359 B1 * 11/2001 Nakane ..... 399/66
6,829,450 B2 * 12/2004 Tamiya et al. ..... 399/66

FOREIGN PATENT DOCUMENTS

| | | |
|---|---|---|
| JP | 64-74571 | 3/1989 |
| JP | 6-289686 | 10/1994 |
| JP | 9-34269 | 2/1997 |
| JP | 11-24433 | 1/1999 |

* cited by examiner

*Primary Examiner*—Hoan Tran
(74) *Attorney, Agent, or Firm*—Westerman, Hattori, Daniels & Adrian, LLP

(57) ABSTRACT

An image forming apparatus in which respective color visible images on tandem-arrayed plural photoconductor drums are sequentially overlay-transferred onto an intermediate transfer belt by application of a primary transfer voltage by intermediate transfer rollers, then the images are transferred at a time from the belt onto a print sheet by application of a secondary transfer voltage by a paper transfer roller. The same primary transfer voltage is applied to the respective color intermediate transfer rollers from one power source. In the intermediate transfer belt, a relative dielectric constant, a surface resistance and a volume resistance are controlled such that potential charged by initial transfer is attenuated to ⅓ or lower than the transfer voltage before a belt position of the initial transfer arrives at a next transfer position.

13 Claims, 27 Drawing Sheets

COMPARATIVE EXAMPLE

OPTIMUM EXAMPLE

COMPARATIVE EXAMPLE

OPTIMUM EXAMPLE

COMPARATIVE EXAMPLE

OPTIMUM EXAMPLE

IMAGE FORMING APPARATUS

This application is a continuation of international application PCT/JP01/00165, filed Jan. 12, 2001.

BACKGROUND OF THE INVENTION

1. Field of the Invention

The present invention relates to an image forming apparatus such as a printer or copier which forms a color image by an electrophotographic process and an image forming method, and more particularly, to an image forming apparatus which performs an intermediate transfer process to overlay-transfer respective color toner images, formed on plural photoconductor drums, onto an intermediate transfer belt and then finally transfer the images onto a print sheet.

2. Description of Related Art

Conventionally, image forming apparatuses such as a printer which form a color image by using an electrophotographic process are roughly classified into 4-pass type and single-pass type (tandem type) apparatuses.

FIG. 1 shows a conventional 4-pass type process. The 4-pass type image forming apparatus has a single photoconductor drum 100 and a developing unit 106 for forming yellow (Y), magenta (M), cyan (C) and black (K) color images. The surface of the photoconductor drum 100 is uniformly charged by a charger 102 in the rear of a cleaning blade 101, and an electrostatic latent image is formed by laser scanning by an exposure unit 104. Next, a yellow toner image is formed by development using yellow toner in a developing unit 106, and the toner image is electrostatically transferred onto a transfer belt 108 as an intermediate transfer medium in contact with the photoconductor drum 100 by application of primary transfer voltage $V_{T1}$ by a transfer roller 110. Then, the same processing is repeated for magenta, cyan and black colors and the respective color toner images are overlaid on the transfer belt 108. Finally, the 4 color developers are transferred onto a print sheet at a time by a transfer roller 111 to which a secondary transfer voltage $V_{T2}$ is applied, and the image is fixed onto the print sheet by a fixer 112.

Since electric charge is accumulated on the transfer belt 108 and the print sheet, the potential on the transfer belt 108 after transfer shows a mild attenuation characteristic. In the case of the 4-pass type process, the next transfer is performed after one rotation of the transfer belt. As shown in FIG. 2, there is sufficient time between transfer at time t1 and the next transfer at time t2. Since a toner potential 114 and a transfer belt potential 116 by a transfer voltage $V_{T1}$ are sufficiently attenuated during this time interval, the application of the same transfer voltage $V_{T1}$ can be repeated 4 times.

In this manner, the case of the 4-pass type image forming apparatus, which merely has the photoconductor drum 100, the cleaning blade 101, the charger 102, the exposure unit 104 and the transfer roller 110, is advantageous in terms of cost. However, to form one color image, the intermediate transfer belt 108 must be rotated 4 times, and the speed of color printing is ¼ of that of monochrome printing.

FIG. 3 shows a conventional single-pass type (tandem type) process (Japanese Published Unexamined Patent Application No. Hei 11-249452). In the single-pass type image forming apparatus, image forming units 118-1 to 118-4 are arrayed for respective yellow (Y), magenta (M), cyan (C) and black (K) colors. That is, the image forming units 118-1 to 118-4 have photoconductor drums 120-1 to 120-4 and cleaning blades, chargers, LED exposure units and developing units around the drums, and the image forming units 118-1 to 118-4 form respective color images. The respective color images formed on the photoconductor drums 120-1 to 120-4 are electrostatically and sequentially overlay-transferred onto an intermediate transfer belt 116 which turns while it is in contact with the respective color photoconductor drums 120-1 to 120-4 by application of transfer voltage by transfer rollers 122-1 to 122-4. Finally, the overlaid color images are transferred onto a print sheet at a time by application of transfer voltage by a paper transfer roller 134 provided on the opposite side of a backup roller 132, and fixed to the print sheet by a fixer 122, thus a color image is obtained.

As the transfer belt 116 is used as an intermediate transfer medium, the transfer from the photoconductor drum to the intermediate transfer belt is generally referred to as primary transfer, and the transfer from the intermediate transfer belt to the print sheet, secondary transfer. Further, generally, the transfer rollers 122-1 to 122-4 for the transfer from the photoconductor drums 120-1 to 120-4 to the intermediate transfer belt 116 and the paper transfer roller 134 for the transfer from the intermediate transfer belt 116 to the print sheet are conductive sponge rollers.

In the case of the single-pass type process in the above arrangement, a color image can be formed by one pass, the print speed is faster than that in the case of the 4-pass type process.

FIG. 4 shows a potential attenuation curve of the intermediate transfer belt in the single-pass type process in FIG. 3. In the single-pass type apparatus, yellow, magenta, cyan and black color toner images are developed on the respective photoconductor drums 120-1 to 120-4 and sequentially transferred onto the intermediate transfer belt 116. First, at time t1, a transfer voltage $V_T$ is applied as a yellow transfer voltage $V_{TY}$ and the yellow image is transferred from the photoconductor drum 120-1 to the intermediate transfer belt 116, then a potential 144-1 on the belt shows a mild attenuation characteristic since electric charge is accumulated on the intermediate transfer belt 116. A residual potential $\Delta V2$ remains upon the next transfer from the magenta photoconductor drum 120-2. Accordingly, to obtain an effective transfer voltage $V_T$ for the magenta image on the photoconductor drum 120-2 at time t2, a transfer voltage $V_{TM}$ must be increased by the residual potential $\Delta V2$. Similarly, a cyan transfer voltage $V_{TC}$ at time t3 and a black transfer voltage $V_{KT}$ at time t4 must be increased by respective residual potentials $\Delta V3$ and $\Delta V4$. For this reason, in the single-pass type image formation process using the intermediate transfer belt, the transfer voltage must be set to appropriate values for the respective colors. As a result, 4 specialized high-voltage power sources must be provided for the 4 colors, and further, 1 high-voltage power source must be provided for the secondary transfer, i.e., total 5 high-voltage power sources must be provided. Thus the transfer power sources are complicated and the costs are increased.

On the other hand, in both types of image forming processes, in color image formation by overlay-transferring colors onto a print sheet or an intermediate transfer medium, upon transfer from secondary colors except monochrome primary color, as toner is overlaid on a previous color toner, a higher transfer voltage than that for the primary color is required. Since the previous color toner has an electric charge, the transfer electric field is weakened upon transfer of the next toner. Generally, a voltage margin (voltage allowance) of transfer efficiency is designed to have allowance to a certain degree. If the voltage margins of transfer efficiencies for the primary to tertiary colors overlap with each other, transfer from the primary to tertiary colors can be excellently performed.

However, it is difficult to ensure a voltage margin to satisfy the transfer from the primary to tertiary colors and to increase the reliability of transfer characteristics. For this purpose, the following various methods have been proposed or performed.

(1) Reduction of Toner Adhesion Amount

In color-overlay transfer, it is the most difficult to perform transfer to generate black color as a tertiary color by overlaying yellow, magenta and cyan. Accordingly, so-called under color removal (UCR) is often performed to replace color toner with black toner at 100% or some percentage. In this case, the color reproduction range of a color image formed by use of 3 colors is narrowed.

(2) Optimization of Each Color Toner Charging Amount

Optimization of each color toner charging amount is known (Japanese Published Unexamined Patent Application Nos. Hei 6-202429, Hei 8-106197 and Hei 10-207164). However, in this method, as toner charging amounts are different, it is necessary to optimize developing conditions for respective colors, and further, it is necessary to determine toner manufacturing methods for respective colors.

(3) Control of Toner Charging Amount Before Transfer

Charging toner by a non-contact charger to obtain an optimum charging amount for overlay-transfer prior to the overlay transfer is known (Japanese Published Unexamined Patent Application No. Hei 8-15947). In this method, as another charger is required, the costs for the charger and power source used for the charger are increased, and further, as the space for the charger must be ensured, the apparatus is upsized.

(4) Optimization of Transfer Voltage

Optimization of transfer voltage for each color to attain stable transfer is known (Japanese Published Unexamined Patent Application No. Hei 11-202651). In this method, in the case of tandem type process, the power source is required for each color, and the costs are increased.

SUMMARY OF THE INVENTION

Accordingly, one aspect of the present invention is to provide a cost-reduced image forming apparatus by commonality of a power source to supply a primary transfer voltage for sequentially overlay-transfer different color images formed on plural photoconductor drums onto an intermediate transfer belt.

Further, another aspect of the present invention is to provide a cost-reduced image forming apparatus by commonality of a power source for primary transfer to sequentially overlay-transfer different color images from photoconductor drums onto an intermediate transfer belt and the secondary transfer to transfer the overlaid images from the intermediate transfer belt to a print sheet at a time.

Further, another aspect of the present invention is to provide a cost-reduced image forming apparatus in which the stability of color-overlay-transfer is increased without influence on developing unit and power source.

(Commonality of Transfer Power Source)

According to the present invention, provided is an image forming apparatus including: plural image forming units that form respective color visible images by electrostatically applying different color developers onto respective color image holders; a belt transfer member such as an intermediate transfer belt, in contact with the respective color image holders, to sequentially overlay-transfer the developers applied on the image holders of the image forming units; intermediate transfer electrode members such as intermediate transfer rollers, positioned on an opposite side to the image holders of the image forming units, via and in contact with the belt transfer member, that receive application of a primary transfer voltage so as to electrostatically transfer the images from the image forming units onto the belt transfer member; and a paper transfer electrode member such as a paper transfer roller, positioned on an opposite side to a backup member, via and in contact with the belt transfer member, that receives application of a secondary transfer voltage so as to transfer the visible images transferred on the belt transfer member onto a print sheet at a time, wherein the primary transfer voltage is applied to the plural intermediate transfer electrode members from one power source.

Note that in the belt transfer member, a relative dielectric constant, a surface resistance and a volume resistance are controlled so as to attenuate a potential charged upon initial transfer to ⅓ or lower than the primary transfer voltage before a belt position of the initial transfer arrives at a next transfer position. Generally, the intermediate transfer belt used in the present invention is made of a high polymer film, and carbon is used for control of resistance value. As the material of the belt, polyimide, PVDF, ETFE, polycarbonate and the like are available. If carbon is added for resistance control, the relative dielectric constant $\in$ is increased. Especially in the case of single-pass type transfer, as the transfer process is repeated in a short period, electric charge is accumulated on the intermediate transfer belt. Accordingly, in the present invention, to apply the same primary transfer voltage from one power source, optimum areas of voltage resistance $\rho$, surface resistance S and the relative dielectric constant $\in$ of the intermediate transfer belt are determined such that the accumulated charge is attenuated to a predetermined level within a period where the transfer belt moves between the photoconductor drums, and mutual influence is prevented.

If the volume resistance $\rho$ in a thickness direction of the intermediate transfer belt is high, the belt potential is not attenuated but electric charge is accumulated, on the other hand, if the volume resistance $\rho$ is too low, electric charge is leaked upon application of transfer voltage and which degrades the transfer efficiency. Further, the surface resistance S of the intermediate transfer belt may be high, however if it is too low, it influences the photoconductor drum, which causes defects of image such as thin spot and toner dispersion in transfer. Further, the attenuation of belt potential is represented by a time constant $\tau$ obtained by multiplying the volume resistance $\rho$ by the relative dielectric constant $\in$. However, as the intermediate transfer belt mainly includes a high polymer film, the volume resistance $\rho$ has voltage dependency that the resistance changes dependently on a voltage V. That is, when the voltage V is high, the volume resistance $\rho$ is low, while when the voltage V is low, the volume resistance $\rho$ is high. Accordingly, to attenuate the potential of the intermediate transfer belt, it is necessary to reduce the volume resistance $\rho$ when the voltage is high, and when the voltage is low, the volume resistance $\rho$ is rather increased and the attachment of toner to the belt is enhanced such that toner dispersion is effectively prevented. Further, the surface resistance S of the intermediate transfer belt must be set so as to increase electrical independency (isolation) among the photoconductor drums for elimination of mutual influence.

According to the present invention, in the intermediate transfer belt having the above characteristics, it has been empirically found that the relative dielectric constant $\in$ is 8 or higher; the surface resistance S is $1\times10^9$ Ω/□ or higher by measurement at 1000 V; and the volume resistance ρ is $10^{10}$ Ω·cm or higher by measurement at 100 V and $10^{10}$ Ω·cm or lower by measurement at 500 V, as optimum values for the belt transfer member. Further, it has been empirically found that the intermediate transfer electrode member is a transfer roller with a sponge layer on its periphery, and the optimum transfer roller resistance is $1\times10^7$Ω or lower.

In this manner, according to the present invention, as the volume resistance ρ, the surface resistance S and the relative dielectric constant ∈ of the intermediate transfer belt are optimized in consideration of voltage dependency, mutual influence among the photoconductor drums can be eliminated, and further, potential attenuation can be sufficiently attained. Accordingly, the same voltage can be supplied from one power source to the intermediate transfer rollers as plural intermediate transfer electrode members, thus the number of transfer power sources can be reduced to 2 power sources for primary transfer and secondary transfer.

(Intermediate Transfer Belt)

Further, the present invention provides an intermediate transfer belt used for primary transfer to electrostatically and sequentially overlay-transfer images of different-color developers, formed on plural image holders arrayed in a belt movement direction onto a belt transfer member, and for secondary transfer to transfer the overlaid images onto a print medium at a time. In the intermediate transfer belt, a relative dielectric constant ∈, a surface resistance S and a volume resistance ρ are controlled so as to attenuate a potential charged upon initial primary transfer to ⅓ or lower than the primary transfer voltage before a belt position of the initial primary transfer arrives at a next primary transfer position. More particularly, the relative dielectric constant ∈ is 8 or greater, the surface resistance S is $1\times10^9$ Ω/□ or higher by measurement at 1000 V, the volume resistance ρ is $10^{10}$ Ω·cm or higher by measurement at 100 V and $1\times10^{10}$ Ω·cm or lower by measurement at 500 V.

(Volume Resistance Measuring Method for Intermediate Transfer Belt)

Further, the present invention provides a measuring method for measuring the volume resistance of the intermediate transfer belt used in the image forming apparatus. The measuring method includes a measurement step of applying an arbitrary transfer voltage to be measured between electrodes in contact with front and rear surfaces of the intermediate transfer belt and measuring an attenuation characteristic of a belt potential to elapsed time from stoppage of application of the transfer voltage; and a calculation step of calculating a volume resistance ρ depending on a change of the belt potential, based on a result of measurement of the attenuation characteristic of the belt potential.

For example, at the measurement step, the belt potential is measured by predetermined time Δt from the stoppage of application of the transfer voltage, and at the calculation step, assuming that the belt potential at time $t_n$ is $V(t_n)$; the belt potential at time $t_{n-1}$ previous of the time $t_n$ by the predetermined time Δt, $V(t_{n-1})$; ∈*, a relative dielectric constant; and $\in_0$, a vacuum dielectric constant of $8.854\times10^{-12}$ [F/m], the volume resistance ρ depending on the belt potential $V(t_n)$ is calculated by:

$$\rho[\{V(t_{n-1})+V(t_n)\}/2]=\Delta t/\{\in^*\in_0(\ln V(t_{n-1})-\ln V(t_n)\}$$

To determine the optimum value of the volume resistance of the intermediate transfer belt, it is necessary to accurately measure the belt volume resistance having voltage dependency. In the conventional volume resistance measurement, a general measurement device such as High resistance meter HP4339A (product of Hewlett Packard Co.) is used. However, in the case where the potential attenuation characteristic is obtained from the volume resistance ρ measured by the general measurement device, the potential is not attenuated so much, and the obtained value is far from the actually-measured belt potential attenuation characteristic. Accordingly, the inventor of the present invention has found that the volume resistance of the intermediate transfer belt has volume dependency and newly made the measuring method of measuring the volume resistance having voltage dependency. The volume resistance measuring method of the present invention is to measure the attenuation characteristic upon application of voltage and calculating volume resistance depending on the voltage from the attenuation characteristic. In this method, a volume resistance accurately corresponding to an actual attenuation characteristic can be measured. By this measurement, the resistance value of the high polymer film using carbon as the intermediate transfer belt can be accurately controlled to set the volume resistance ρ to $10^{10}$ Ω·cm or higher by measurement at 100 V and $10^{10}$ Ω·cm or lower by measurement at 500 V.

(Commonality of Primary Transfer Power Source and Secondary Transfer Power Source)

The present invention provides an image forming apparatus in which commonality of the primary transfer power source and the secondary transfer power source is realized. Provided is an image forming apparatus including: plural image forming units that form respective color visible images by electrostatically applying different color developers onto respective color image holders; a belt transfer member, in contact with the respective color image holders, to sequentially overlay-transfer the developers applied on the image holders of the image forming units; intermediate transfer electrode members, positioned on an opposite side to the image holders of the image forming units, via and in contact with the belt transfer member, that receive application of a primary transfer voltage so as to electrostatically transfer the images from the image forming units onto the belt transfer member; and a paper transfer electrode member, positioned on an opposite side to a backup member, via and in contact with the belt transfer member, that receives application of a secondary transfer voltage so as to transfer the visible images transferred on the belt transfer member onto a print sheet at a time, wherein the primary transfer voltage applied to the plural intermediate transfer electrode members and the secondary transfer voltage applied to the paper transfer electrode member are supplied from one power source. For example, the secondary transfer voltage is directly supplied from the power source to the paper transfer electrode member, and the primary transfer voltage, from the power source and lowered via a voltage drop member, is supplied to the plural intermediate transfer electrode members.

In this manner, as the difference between the primary transfer voltage and the secondary transfer voltage is controlled by the voltage drop member such as a resistor, the primary transfer voltage and the secondary transfer voltage can be supplied from the same power source. The costs of the transfer power sources can be suppressed and the apparatus can be downsized.

(Control of Same Transfer Power Source and Transfer Efficiency)

In the case where the transfer voltage is supplied from the same power source to plural transfer portions, the present invention provides an image forming apparatus in which optimum transfer conditions can be set for the respective transfer portions. That is, the present invention provides an image forming apparatus including: plural image forming units that form respective color visible images by electrostatically applying different color developers onto respective color image holders; a belt transfer member, in contact with the respective color image holders, to sequentially overlay-transfer the developers applied on the image holders of the image forming units; plural intermediate transfer electrode members, positioned on an opposite side to the image holders of the image forming units, via and in contact with the belt transfer member, that apply a primary transfer voltage so as to electrostatically transfer the images from the image forming units onto the belt transfer member; a paper transfer electrode member, positioned on an opposite side to a backup member, via and in contact with the belt transfer member, that receives application of a secondary transfer voltage so as to transfer the visible images transferred on the belt transfer member onto a print sheet at a time; and a primary transfer power source to apply the same primary transfer voltage commonly to the plural intermediate transfer electrode members, wherein resistance values of the plural intermediate transfer electrode members are set to a higher value for a transfer portion in which a number of overlaid colors is smaller and to a lower value for a transfer portion in which a number of overlaid colors is larger.

In this construction, the toner characteristics for the respective colors are not intentionally changed. Further, even in a case where a single transfer power source is used, the effective transfer voltage increases in a transfer portion where the number of overlaid colors which are difficult to overlay-transfer is larger by resistance of the transfer voltage electrode member itself. Thus the transfer of monochrome primary color and higher-order colors, by overlaying plural colors, can be performed in a more stable manner.

Further, according to the present invention, in the image forming apparatus having the above construction, compensation resistors are provided between the primary transfer power source and the plural intermediate transfer electrode members. The resistance values of the respective compensation resistors are set to a higher level in a transfer portion in which the number of overlaid colors is smaller and to a lower level in a transfer portion in which the number of overlaid color is larger. Accordingly, the effective transfer voltage is higher in the transfer portion where the number of overlaid colors which are difficult to overlay-transfer is large by the compensation resistance. Thus the transfer of the primary and higher-order colors can be performed in a more stable manner.

Further, according to the present invention, in the image forming apparatus having the above construction, the plural transfer voltage electrode members include a conductive member. The transfer voltage electrode members are provided in positions in a belt surface direction away from transfer nips as contact positions between the respective color image holders and the belt transfer member. The distance from the transfer nip is shorter for a transfer portion in which the number of overlaid colors is smaller, while the distance is longer for a transfer portion in which the number of overlaid colors is larger. In this arrangement, the distances from the contact position of the belt of the transfer voltage electrode members to a transfer nit that is the contact position of the belt of the image holders such as photoconductor drums are different for respective colors. As the transfer voltage is applied via the intermediate transfer belt as a resistor to the transfer nip, the voltage drop increases in correspondence with the distance. Accordingly, the effective voltage is higher in a transfer portion with a shorter distance in which the number of overlaid colors is large and the overlay-transfer is difficult. Thus the transfer of the primary and higher-order colors can be performed in a more stable manner.

BRIEF DESCRIPTION OF THE DRAWINGS

Preferred embodiments of the present invention will be described in detail based on the followings, wherein.

DETAILED DESCRIPTION OF THE PREFERRED EMBODIMENTS

Figure 1:
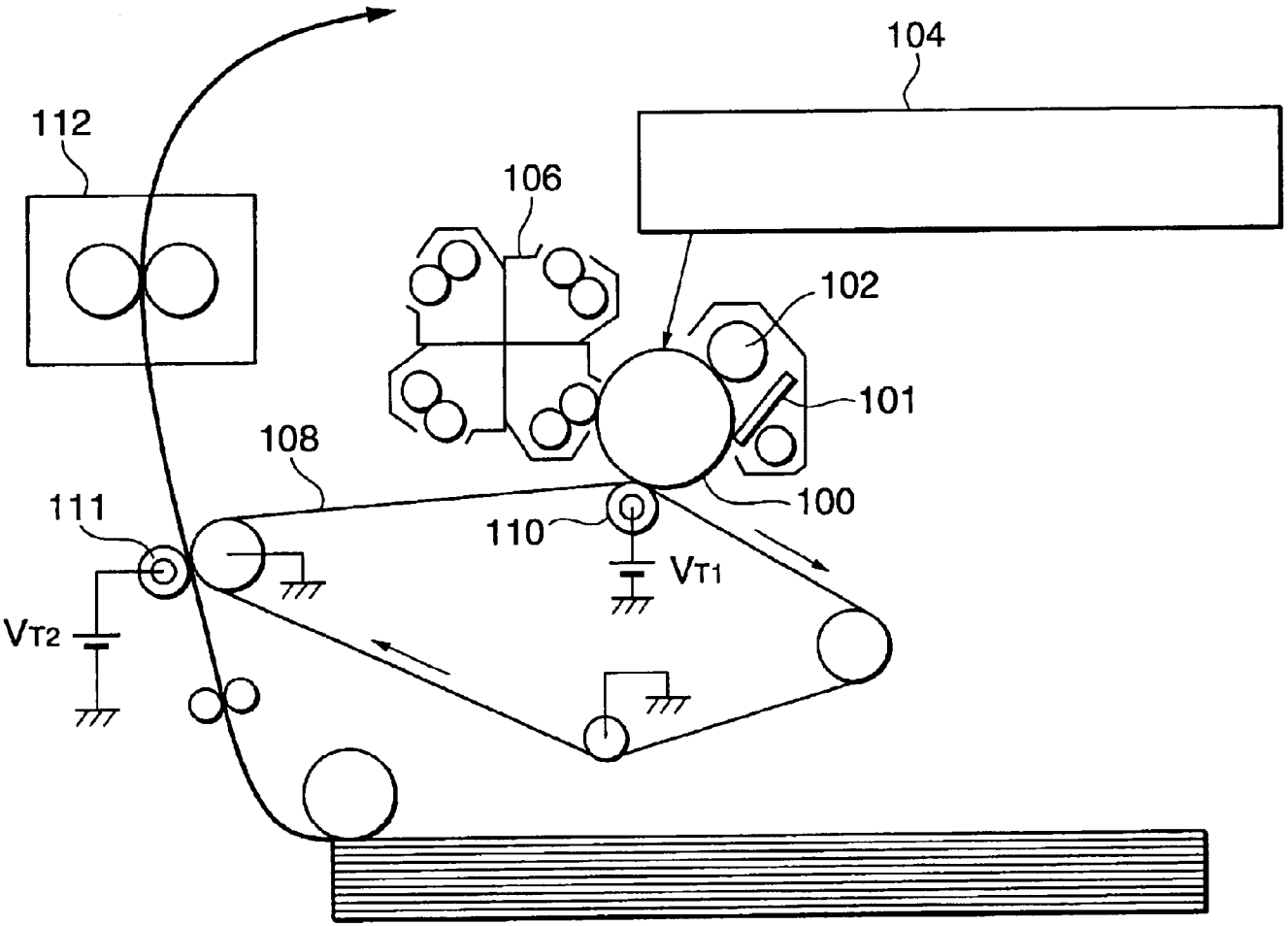
FIG. 1 is a schematic cross-sectional view showing the conventional 4-pass type image formation process.
Figure 2:
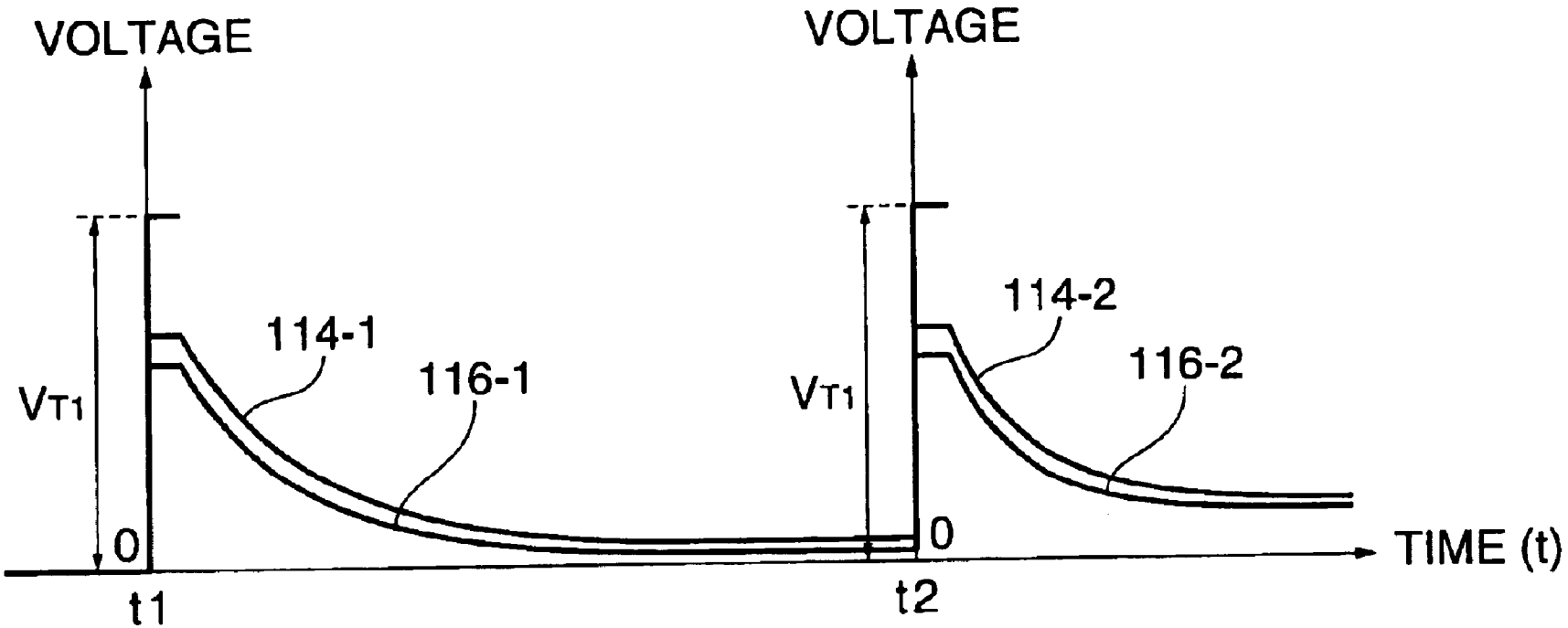
FIG. 2 is a graph showing the belt potential attenuation characteristic in the 4-pass type image formation process in FIG. 1.
Figure 3:
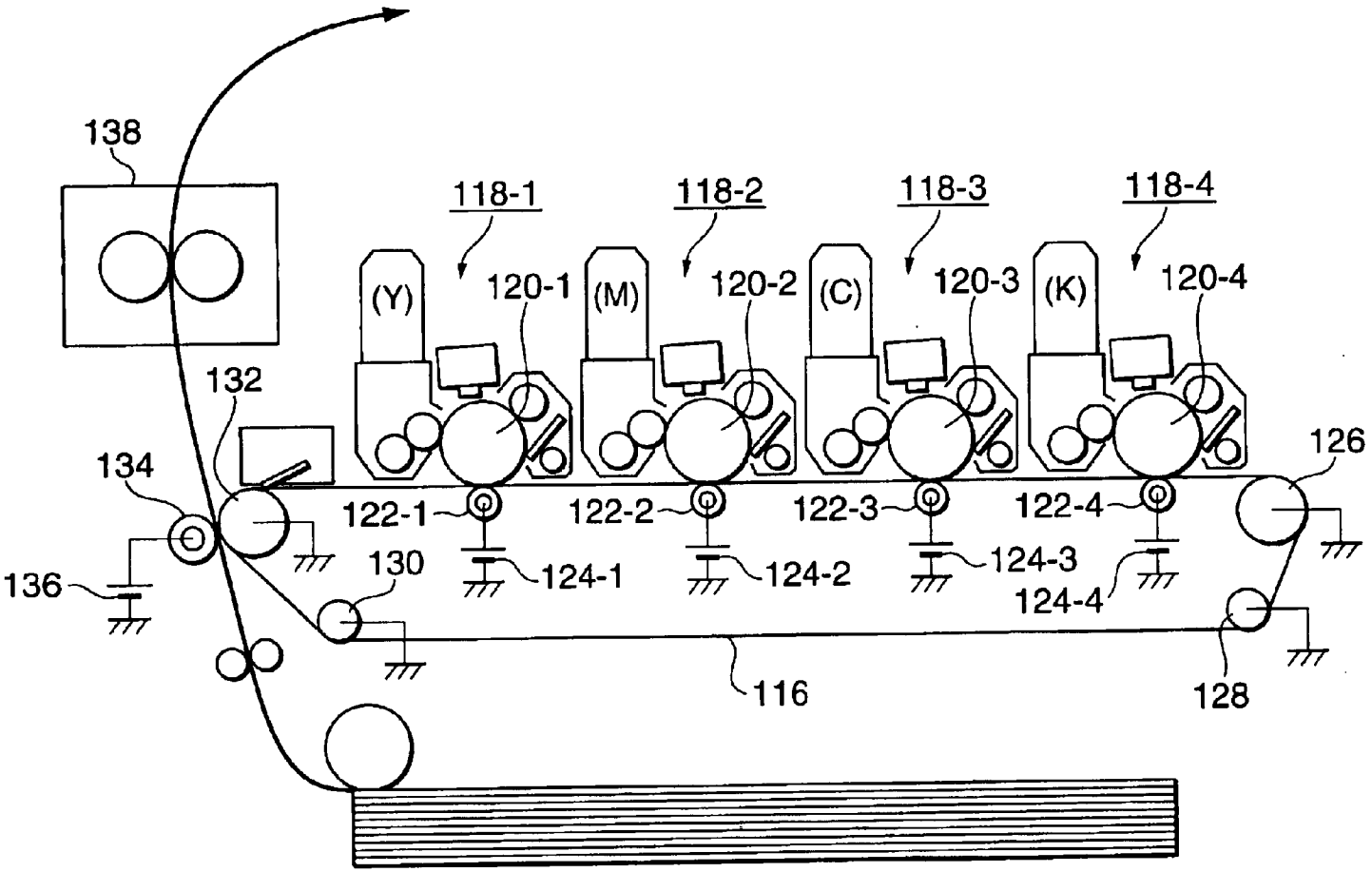
FIG. 3 is a schematic cross-sectional view showing the conventional single-pass type image formation process.
Figure 4:
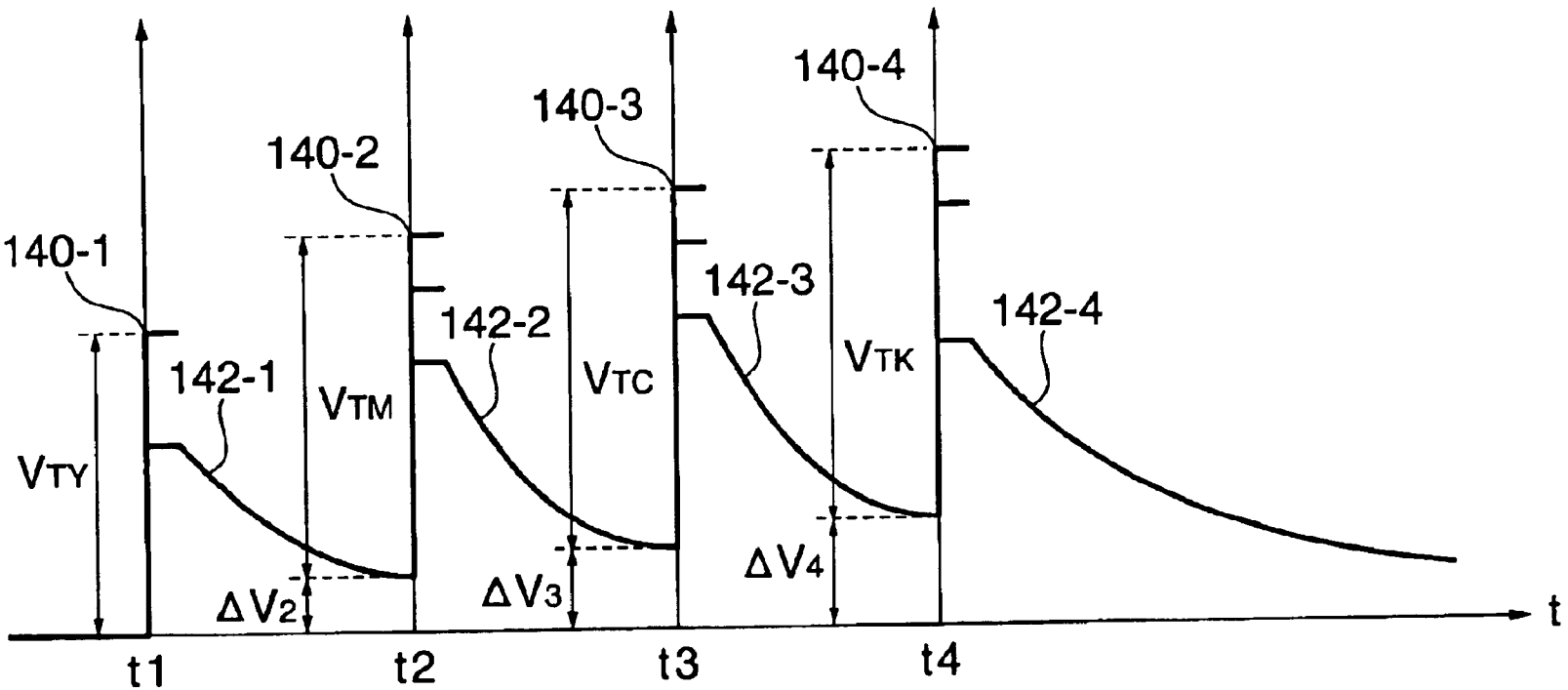
FIG. 4 is a graph showing the belt potential attenuation characteristic in the single-pass type image formation process in FIG. 3.
Figure 5:
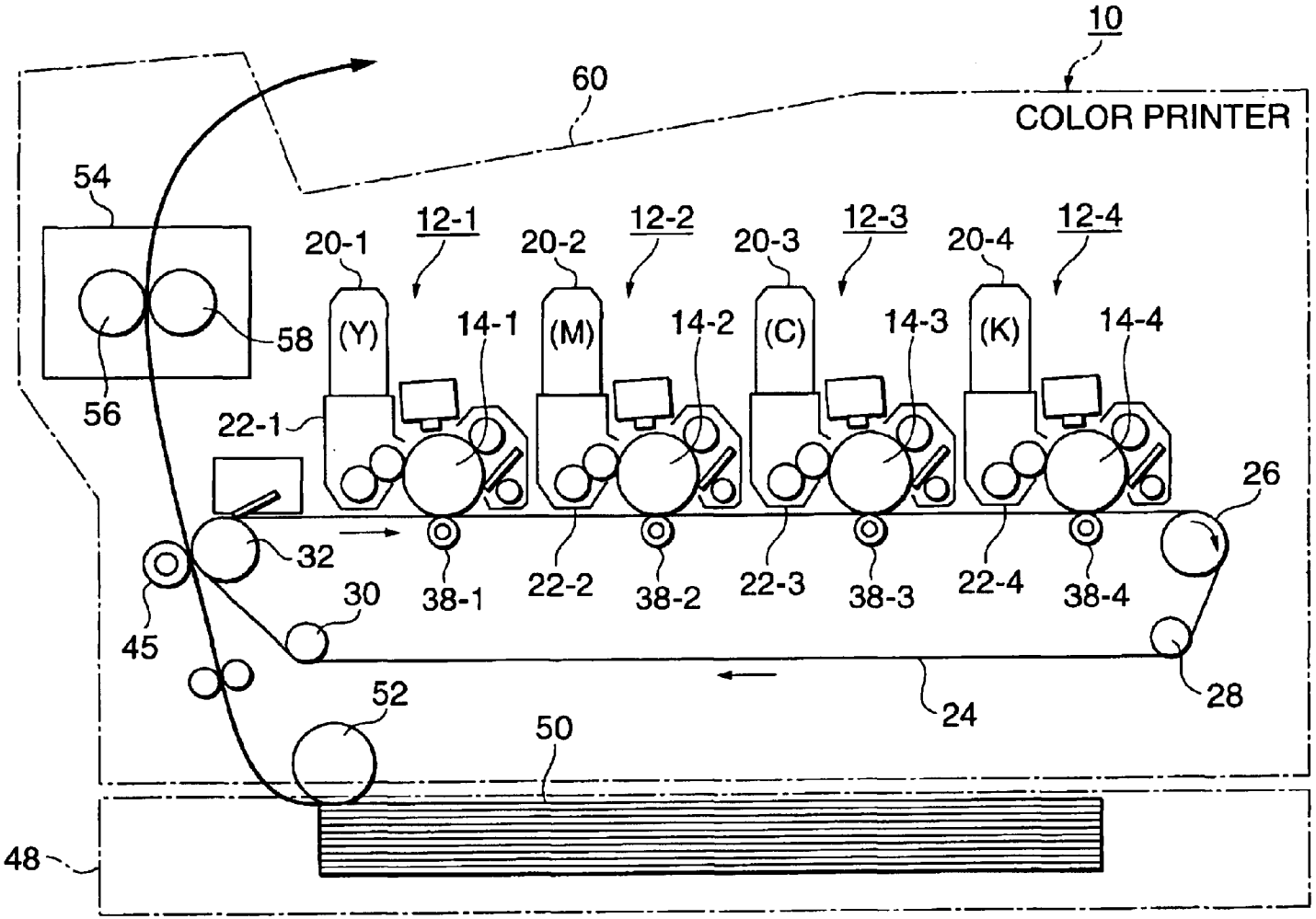
FIG. 5 is a schematic cross-sectional view showing an image forming apparatus according to an embodiment of the present invention.

FIG. 5 is a schematic cross-sectional view showing a color printer as an image forming apparatus which performs an intermediate transfer process according to an embodiment of the present invention. In FIG. 5, a color printer 10 has an intermediate transfer belt 24 placed around a drive roller 26, tension rollers 28 and 30 and a backup roller 32, and image forming units 12-1 to 12-4 for yellow (Y), magenta (M), cyan (C) and black (K) colors provided from the upstream to the downstream of an upper part of the intermediate transfer belt 24. As shown in the yellow (Y) image forming unit 12-1 shown in FIG. 6, the image forming units 12-1 to 12-4 each have a charging brush 16-1, an LED array 18-1 and a developing roller 21-1 of a developing device around a photoconductor drum 14-1 as an image holder, and further, a cleaning blade 15-1 in front of the charging brush 16-1.

Returning to FIG. 5, toner cartridges 20-1 to 20-4 are attached to developing devices 22-1 to 22-4 provided in the image forming units 12-1 to 12-4. Intermediate transfer rollers 38-1 to 38-4 as intermediate transfer electrode members are provided via the intermediate transfer belt 24 on the opposite side to the photoconductor drums 14-1 to 14-4 in the image forming units 12-1 to 12-4. In a printing process by the color printer 10, respective color toner images formed on the photoconductor drums 14-1 to 14-4 of the image forming units 12-1 to 12-4 are sequentially overlay-transferred onto the intermediate transfer belt 24 by the intermediate transfer rollers 38-1 to 38-4, then conveyed via the positions of the drive roller 26, the tension rollers 28 and 30, to a secondary transfer position by a paper transfer roller 45 provided on the opposite side of the backup roller 32. In this the secondary transfer portion, a print sheet 50 pulled out of a tray 48 by a pickup roller 58 is conveyed by the paper transfer roller 45, then the toner image on the intermediate transfer belt 24 is transferred onto the print sheet 50 by a secondary voltage applied between the paper transfer roller 45 and the backup roller 32, then the toner image is heat-adhered to the print sheet 50 by a fixer 54 having a heat roller 56 and a backup roller 58, and the print sheet 50 is discharged on a stacker 60.

Figure 7:
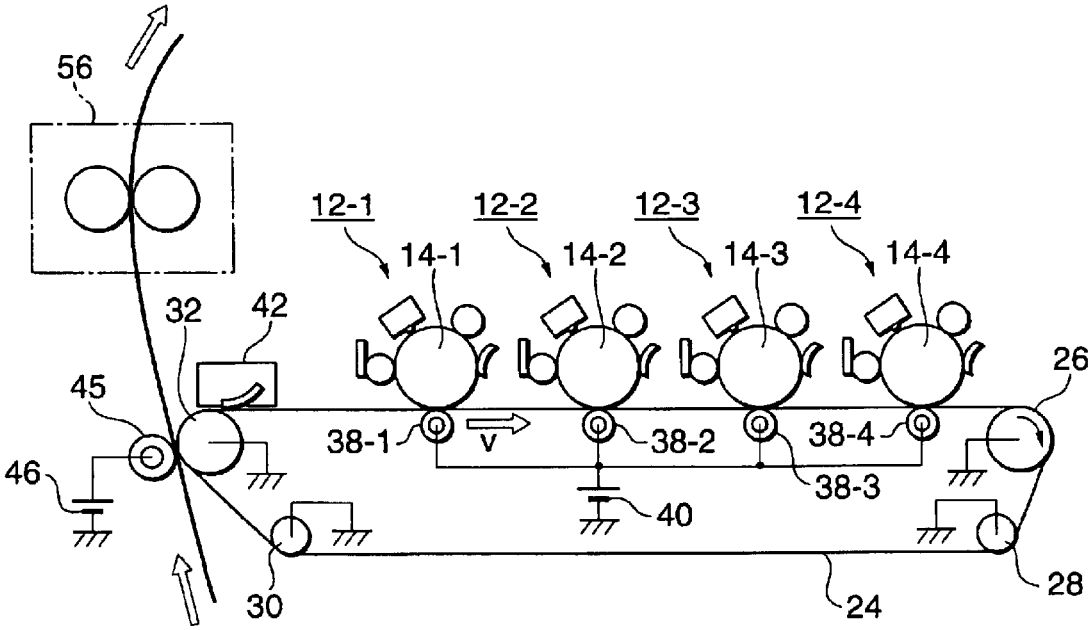
FIG. 7 is a partial schematic cross-sectional view showing a transfer process mechanism in FIG. 5.

FIG. 7 shows a process unit in the color printer 10 in FIG. 5. In FIG. 7, the intermediate transfer rollers 38-1 to 38-4, provided on the opposite side to the photoconductor drums 14-1 to 14-4 of the image forming units 12-1 to 12-4 via the intermediate transfer belt 24, include a sponge roller where a sponge layer is formed around a metal shaft, to receive a predetermined primary transfer voltage of e.g. 1000 V from a common power source 40. The paper transfer roller 45 provided to be opposite to the backup roller 32, also including a sponge roller, receives a predetermined secondary transfer voltage of e.g. 2000 V from a power source 46 at paper transfer timing.

Figure 6:
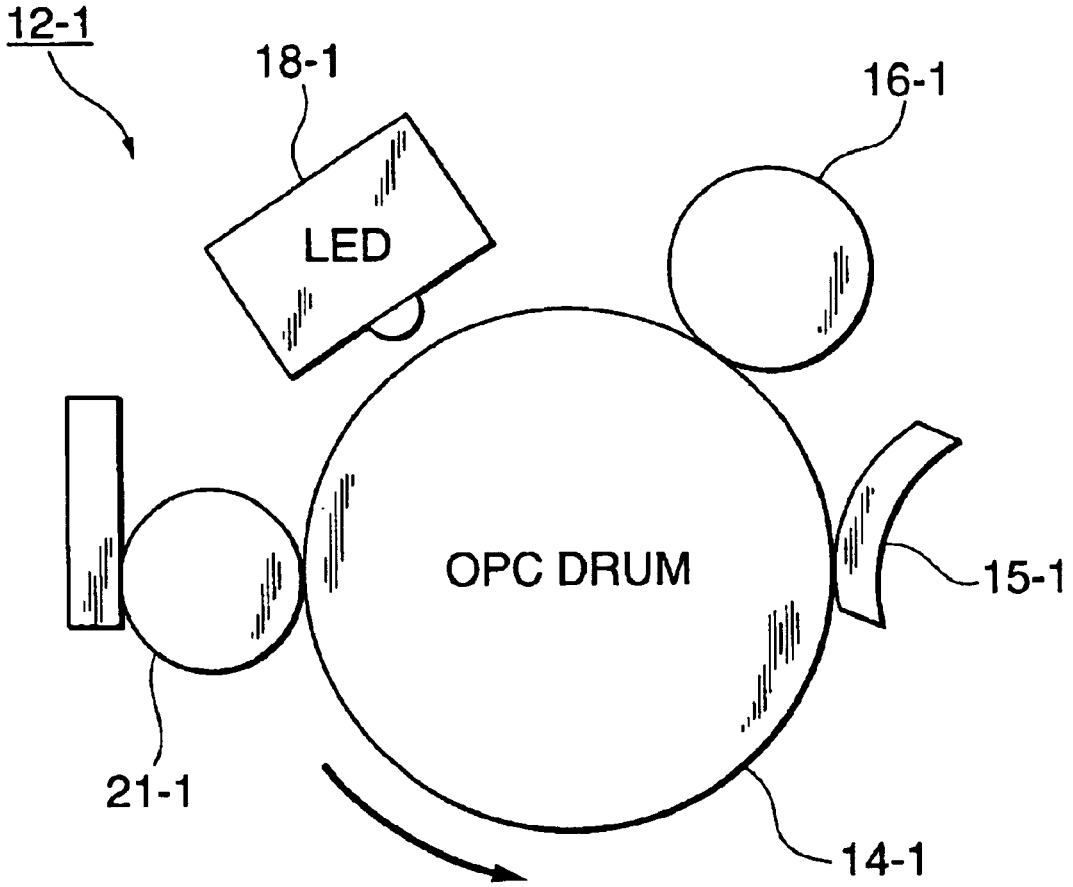
FIG. 6 is a partially-expanded schematic cross-sectional view showing a yellow image forming unit in FIG. 5.

Further, the construction of the respective elements in FIG. 7 will be described. The photoconductor drums 14-1 to 14-4 provided in the image forming units 12-1 to 12-4 include an aluminum rough tube having an outer diameter of 30 mm coated with a photoconductive layer having a thickness of about 25 $\mu$m including a charge generating layer and a charge transport layer. In the case of the yellow (Y) image forming unit 12-1 shown in FIG. 6, the photoconductor drum 14-1 is uniformly charged by the charging brush 16-1. The charging brush 16-1 comes into contact with the surface of the photoconductor drum 14-1, then applies, for example, a bias voltage at 800 Hz, a P-P voltage of 1100 V and an offset voltage of −650 V, to charge the surface of the photoconductor drum 14-1 to about −650 V. As a charger, a corona charger, a solid roller charger and the like can be used as well as the charging brush 16-1. The LED array 18-1 emits light with a wavelength of 740 mn and a resolution of 600 dpi. The LED array 18-1 performs exposure in correspondence with image to form an electrostatic latent image on the surface of the photoconductor drum 14-1. A laser scanning exposure unit or the like can be used as well as the LED array 18-1. In FIG. 6, the electrostatic latent image formed on the surface of the photoconductor drum 14-1 is developed by the developing roller 21-1 using yellow toner, as a developing unit having minus-charged color toner, thus the electrostatic latent image on the photoconductor drum 14-1 is visualized. In this example, non-magnetic single-component process is used as a developing method, however, the developing is not limited to this method. Further, the charging polarity of the toner is not limited to minus.

Returning to FIG. 7, the intermediate transfer rollers 38-1 to 38-4 sequentially overlay-transfer yellow, magenta, cyan and black monochrome color images formed on the photoconductor drums 14-1 to 14-4 in the image forming units 12-1 to 12-4 onto the intermediate transfer belt 24, thus forms a color image on the intermediate transfer belt 24. The timings of overlaying the respective colors onto the intermediate transfer belt 24 are controlled by write-start timing by the LED array, thus accurate alignment is performed. Note that the order of color images and the number of colors are not limited to those in this embodiment.

The transfer from the photoconductor drums 14-1 to 14-4 to the intermediate transfer belt 24 is electrostatically performed by application of predetermined voltage within the range of +500 V to 1000 V to the intermediate transfer rollers 38-1 to 38-4 from the power source 40. The intermediate transfer belt 24 includes e.g. a polycarbonate resin member having a thickness of 150 $\mu$m in which the resistance is controlled by use of carbon.

In the intermediate transfer belt 24 of the present invention, a relative dielectric constant $\in$, a surface resistance S and a volume resistance $\rho$ of the intermediate transfer belt 24 are controlled such that when the initial primary transfer voltage has been applied by the intermediate transfer roller 38-1 and the belt surface has been charged for the image transfer from the photoconductor drum 14-1, the potential of the intermediate transfer belt is attenuated to ⅓ or lower than the transfer voltage before the charged position of the intermediate transfer belt 24 comes to the next transfer position by the photoconductor drum 14-2 and the intermediate transfer roller 38-2. The following optimum values of the relative dielectric constant $\in$, the surface resistance S and the volume resistance $\rho$ of the intermediate transfer belt 24 have been empirically obtained by the inventors of the present invention.

(1) The relative dielectric constant $\in$ of the intermediate transfer belt 24 is 8 or greater.

(2) The surface resistance S of the intermediate transfer belt 24 is $1\times10^{9}$ to $1\times10^{11}$ $\Omega/\square$ by measurement at 1000 V.

(3) The volume resistance $\rho$ of the intermediate transfer belt 24 is $10^{10}$ $\Omega\cdot$cm or higher by measurement at 100 V, and $1\times10^{8}$ to $1\times10^{10}$ $\Omega\cdot$cm by measurement at 500 V.

In the present invention, the details of the optimum values of the relative dielectric constant $\in$, the surface resistance S and the volume resistance $\rho$ will be described later as optimum values to attenuate the belt potential to ⅓ or lower than the transfer voltage during movement of the intermediate transfer belt from the initial transfer position to the next transfer position.

Further, as the intermediate transfer belt 24 of the present invention, the material is not limited to polycarbonate resin member, and resin member of polyimide, nylon, fluorine or the like can be used. Further, it is not necessary to provide the intermediate transfer rollers 38-1 to 38-4 in positions opposite to the photoconductor drums 14-1 to 14-4. The intermediate transfer rollers may be provided in distant positions upstream or downstream of the rotation direction of the intermediate transfer belt 24.

The color image overlay-transferred onto the intermediate transfer belt 24 by the primary transfer is transferred at a time onto a print medium such as a print sheet by a secondary transfer unit. The paper transfer roller 45 for the secondary transfer includes a sponge roller in which the resistance between the shaft and the surface is controlled to about $10^{5}$ to $10^{8}\Omega$. The paper transfer roller 45 presses the intermediate transfer belt 24 held between the paper transfer roller and the backup roller 32 with pressure of about 1 to 2 kg. Further, the hardness of the sponge roller used as the paper transfer roller 45 is Asker C 40 to 60. The power source 46 connected to the paper transfer roller 45 is a constant current source which applies a bias voltage to a print sheet conveyed at synchronized timing to the image position on the intermediate transfer belt 24, thus electrostatically transfers the toner. The color image transferred onto the print sheet by the secondary transfer is fixed to the print sheet by the fixer 56 by heating the developers, thus a fixed color image is obtained. Further, the speed of the intermediate transfer belt 24 by the drive roller 26 is e.g. 91 mm/s. The printing speed determined by the speed of the intermediate transfer belt is not limited to this value but may be a higher or lower speed.

Next, the intermediate transfer belt of the present invention will be described in detail. In the intermediate transfer belt used in the image forming apparatus according to the present invention, the charge accumulated by application of transfer voltage during a period in which the intermediate transfer belt moves between photoconductor drums must be attenuated to a predetermined level, and further, mutual influence must be prevented. The inventor of the present invention has found optimum areas of the volume resistance $\rho$, the surface resistance S and the relative dielectric constant $\in$ of the intermediate transfer belt for this purpose. If the volume resistance $\rho$ of the intermediate transfer belt is high, potential attenuation does not occur but charge accumulation occurs, and if, on the other hand, the volume resistance $\rho$ is too low, the charge is leaked upon application of a transfer voltage and the transfer efficiency is lowered. Further, it is preferable that the surface resistance S of the intermediate transfer belt is high. If the surface resistance S is too low, it influences the respective photoconductor drums, which causes defects of image such as thin spot and toner dispersion in transfer.

The potential attenuation in the intermediate transfer belt is represented as a time constant $\tau$ obtained by multiplying the volume resistance $\rho$ by the relative dielectric constant $\in$ ($=\in\rho$). However, as the intermediate transfer belt mainly includes a high polymer film, the belt has voltage dependency that the volume resistance changes depending on the voltage V. If the voltage V is high, the volume resistance $\rho$ is low, while if the voltage V is low, the volume resistance $\rho$ is high. Accordingly, to attenuate the potential of the intermediate transfer belt, it is necessary to reduce the volume resistance $\rho$ at a high voltage. At a low voltage, the volume resistance $\rho$ is rather increased, so as to improve adhesion of toner to the belt, thereby effectively prevent the toner dispersion in transfer. Further, the surface resistance S of the intermediate transfer belt must be set to a value to increase electrical independency among the photoconductor drums and prevent mutual influence.

As the intermediate transfer belt having the above characteristics, it has been empirically found by the inventor of the present invention that the relative dielectric constant $\in$ is 8 or greater; the surface resistance S is $1\times10^{9}$ to $1\times10^{11}$ $\Omega/\square$ by measurement at 1000 V; and the volume resistance $\rho$ is $10^{10}$ $\Omega\cdot$cm or higher by measurement at 100 V and $1\times10^{8}$ to $1\times10^{10}$ $\Omega\cdot$cm by measurement at 500 V, as optimum values for the intermediate transfer belt.

In this manner, as the relative dielectric constant $\in$, the surface S and the volume resistance $\rho$ of the intermediate transfer belt are optimized in view of the voltage dependency, the mutual influence among the photoconductor drums can be prevented, and further, as the belt potential can be sufficiently attenuated while the belt moves between the photoconductor drums, it is not necessary to consider the influence by offset due to residual voltage in the next transfer position. The primary transfer voltage applied to the respective color intermediate transfer rollers can be supplied from one power source, allowing a configuration of a single power source for primary transfer.

Figure 8:
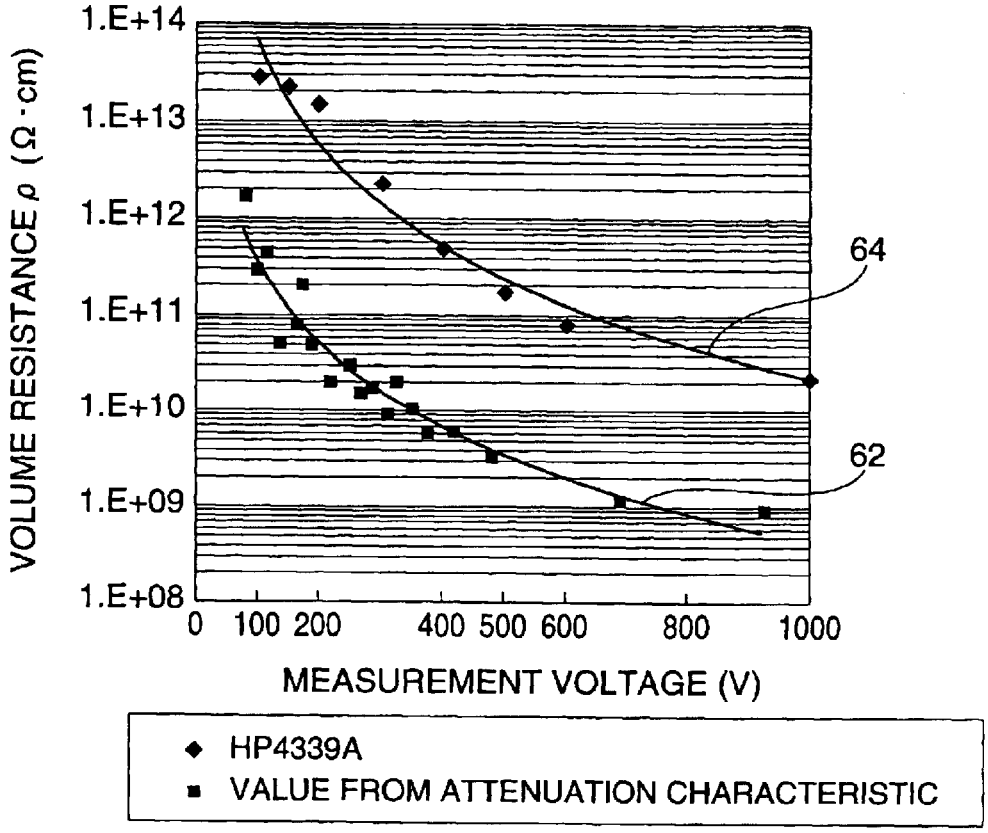
FIG. 8 is a graph showing the characteristic of a volume resistance of an intermediate transfer belt to a measurement voltage.

FIG. 8 is a graph showing the characteristic of the volume resistance of the intermediate transfer belt having voltage dependency. In FIG. 8, a characteristic curve 62 indicates the characteristic of the volume resistance ρ of the intermediate transfer belt of the present invention to a measurement voltage, showing high dependency on the applied voltage. That is, if the measurement voltage is low, the volume resistance ρ is high, while if the measurement voltage is high, the volume resistance ρ is low. In the present invention, the optimum range of the volume resistance ρ of the intermediate transfer belt is $10^{10}$ Ω·cm or higher by measurement at 100 V, and $1\times10^{8}$ to $1\times10^{10}$ Ω·cm by measurement at 500 V. In FIG. 8, the characteristic curve 62 satisfies the condition of this range of the volume resistance.

Figure 9:
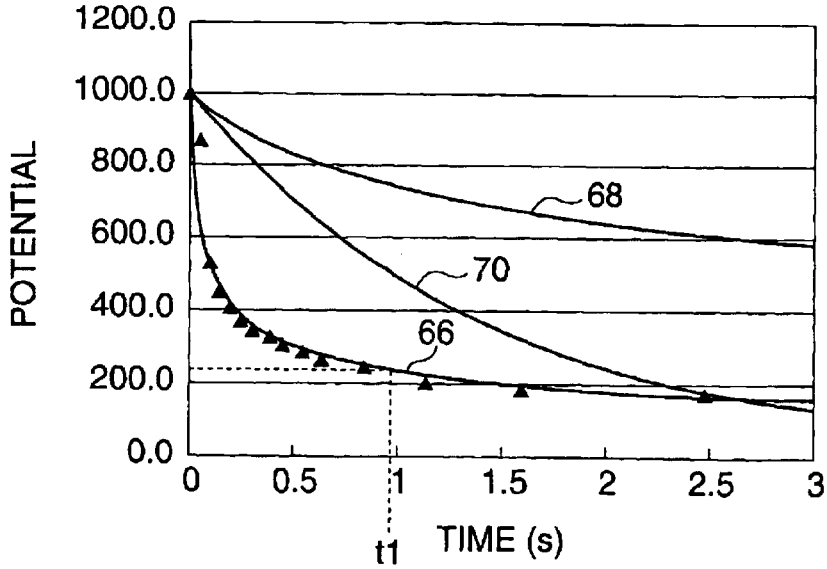
FIG. 9 is a graph showing the characteristic of attenuation measured for obtaining the volume resistance in FIG. 8.

FIG. 9 shows the characteristic of potential attenuation upon application of voltage of 1000 V to the intermediate transfer belt having the volume-dependent volume resistance indicated by the characteristic curve 62 in FIG. 8. The potential attenuation characteristic upon application of the 1000 V voltage shows the result of measurement as a characteristic curve 66. Regarding the attenuation characteristic of the characteristic curve 66, since the volume resistance ρ has voltage dependency, the attenuation is sharp if the voltage is high, while the attenuation is mild if the voltage is low. The time constant τ is represented by a value obtained by multiplying the relative dielectric constant ∈ by the volume resistance ρ. As the volume resistance ρ has voltage dependency, the volume resistance ρ is a function of voltage (ρ(V)). Accordingly, the time constant τ of attenuation characteristic is represented by:

$$\tau=\in\cdot\rho(V) \tag{1}$$

Assuming that ∈*=9.5 holds as the relative dielectric constant ∈ of the intermediate transfer belt, and ∈0=8.854×$10^{-12}$ [F/m] holds as a vacuum dielectric constant, the function ρ(V) calculated from the characteristic curve 66 in FIG. 9 is:

$$\rho(V)=4\times10^{17}\times V^{-3.021} \tag{2}$$

Conventionally, the volume dependency of the volume resistance ρ of the intermediate transfer belt has not been considered, and the specification of the volume resistance is unclear as a parameter upon optimization of potential attenuation characteristic necessary for the intermediate transfer belt. Generally, the measurement of the volume resistance is performed by a measurement device such as High resistance meter HP4339A (product of Hewlett Packard Co.). As indicated in a characteristic curve 64 in FIG. 8, the volume resistance measured by this measurement device is very different from the characteristic curve 62 obtained by measurement in the present invention. In a case where the potential attenuation characteristic is obtained from the volume resistance based on the characteristic curve 64 by the measurement using the general measurement device in FIG. 8, the potential is not attenuated as in a characteristic curve 68 in FIG. 9, and the value is far from the actually-measured characteristic curve 66. Accordingly, the value of the volume resistance measured by the general measurement device cannot be employed to specify the optimum range for the intermediate transfer belt of the present invention.

Further, assuming that the volume resistance of the intermediate transfer belt does not depend on the applied voltage and ρ=$1.15\times10^{11}$ Ω·cm holds as the volume resistance ρ, the calculated potential attenuation characteristic is indicated by a characteristic curve 70 in FIG. 9, also far from the actually-measured attenuation characteristic 66. Accordingly, the condition of the volume resistance ρ of the intermediate transfer belt of the present invention is that the volume resistance has volume dependency, and the attenuation characteristic by constant volume resistance must be excluded. Accordingly, the characteristic curve 62 of the volume resistance ρ depending on the measurement voltage shown in FIG. 8 is obtained by calculation from the actual attenuation characteristic 66 in FIG. 9.

The volume resistance having voltage dependency in FIG. 8 is obtained from the attenuation characteristic in FIG. 9 as follows. The attenuation characteristic is basically represented by a CR equivalent circuit. Accordingly, the potential to elapsed time is given by:

$$V(t) = V_0 \bullet \exp\left(-\frac{t}{CR}\right) \tag{3}$$

V(t): potential after time t

Vo: initial potential

C: capacitance

R: resistance

Note that in the capacitance C, the voltage dependency from the relative dielectric constant ∈ to be described later can be ignored. Accordingly, as only the resistance R has voltage dependency, the expression (4) is as follows.

$$V(t) = V_0 \bullet \exp\left(-\frac{t}{CR(V(t))}\right) \tag{4}$$

From the expression (4), (R(V(t)) is:

$$R(V(t)) = \frac{t}{C(lnV_0 - lnV(t))} \tag{5}$$

In the expression (5), if time t is discretely taken, the value V(t) is measured by Δt, and R(V(t)) is the resistance R depending on a mean value of V(t) by Δt, the expression (6) is as follows.

$$R\left(\frac{V(t_{n-1}) - V(t_n)}{2}\right) = \frac{\Delta t}{C(lnV(t_{n-1}) - lnV(t_n))} \tag{6}$$

Note that the resistance R and the capacitance C are obtained by:

$$R = \frac{\rho d}{S} \tag{7}$$

$$C = \frac{\varepsilon^* \varepsilon_0 S}{d} \text{ Accordingly,} \tag{8}$$

$$\rho\left(\frac{V(t_{n-1}) - V(t_n)}{2}\right) = \frac{\Delta t}{\varepsilon^* \varepsilon_0 (lnV(t_{n-1}) - lnV(t_n))} \tag{9}$$

As described above, the measurement result of the volume resistance ρ having voltage dependency as indicated by the characteristic curve 62 in FIG. 8 can be obtained by obtaining the potential by Δt in the attenuation characteristic curve 66 as the measurement result in FIG. 9 and sequentially substituting the potential into the expression (9).

Figure 10:
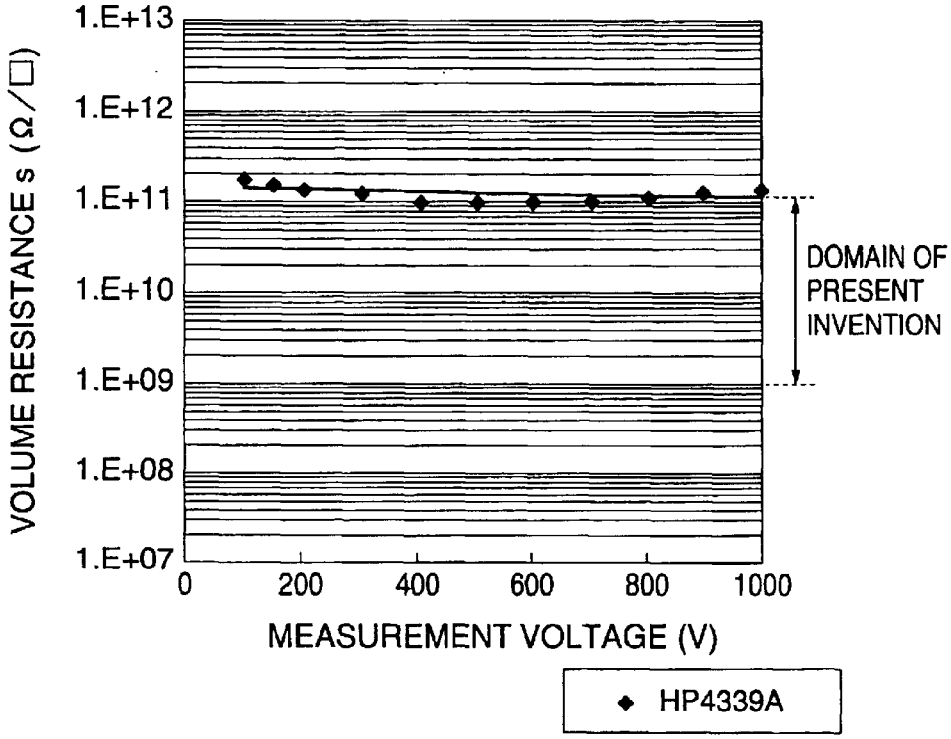
FIG. 10 is a graph showing the characteristic of a surface resistance of the intermediate transfer belt to the measurement voltage.

FIG. 10 is a graph showing the characteristic of the surface resistance S of the intermediate transfer belt having the voltage dependency. As the surface resistance S of the intermediate transfer belt of the present invention, a value around 1E+11 i.e. $1\times10^{11}$ Ω/□ is maintained in the range of measurement voltage of 100 V to 1000 V. Accordingly, it is understood that the voltage dependency almost can be ignored. The measurement of the surface resistance in FIG. 10 is performed by using High resistance meter HP4339A (product of Hewlett Packard Co.).

Figure 11:
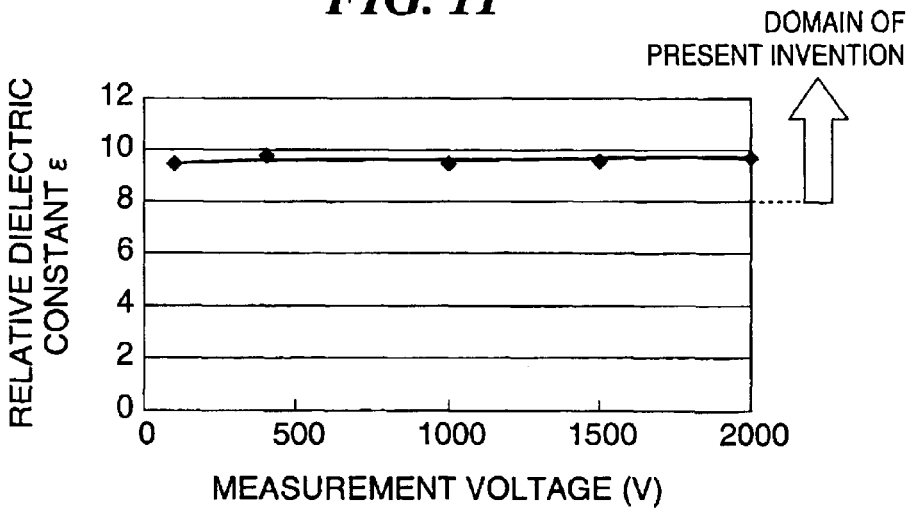
FIG. 11 is a graph showing the characteristic of a relative dielectric constant of the intermediate transfer belt to the measurement voltage.

FIG. 11 is a graph showing the characteristic of the relative dielectric constant ∈ of the intermediate transfer belt having voltage dependency. In the relative dielectric constant ∈, as a value around ∈=9.5 is maintained within the range of measurement voltage 100 V to 2000 V, it is understood that the voltage dependency can be ignored.

Next, the relation between the volume resistance ρ having voltage dependency and the relative dielectric constant ∈ where the voltage dependency almost can be ignored in the intermediate transfer belt of the present invention will be described. The relative dielectric constant ∈ of the intermediate transfer belt is necessary to hold the charge on the belt and increase adhesion of conveyed toner so as to prevent thin spot and toner dispersion in transfer. The range of the relative dielectric constant ∈ relates to the time constant τ of the attenuation characteristic and influences attenuation in a discharge curve. The charge applied on the intermediate belt is accumulated during transfer. If the charge is high, as a part of transfer voltage in the next transfer position is canceled and it acts as residual potential, the charge must be held within a certain range. Accordingly, in the intermediate transfer belt, it is necessary to quickly discharge the charge when the potential is high while to hold the charge when the potential is low. The voltage dependency of the volume resistance ρ of the intermediate transfer belt has a triple-digit change within the voltage range of 100 V to 1000 V as shown in the characteristic curve 62 in FIG. 8. The relative dielectric constant ∈ to hold charge is a significant factor mainly in a low-resistance area. In the transfer belt, 300 V or lower is necessary as charge holding characteristic, and preferably, about 100 V is necessary. Accordingly, it is preferable that the relative dielectric constant ∈ is high even in a 300 V or lower area.

Figure 12:
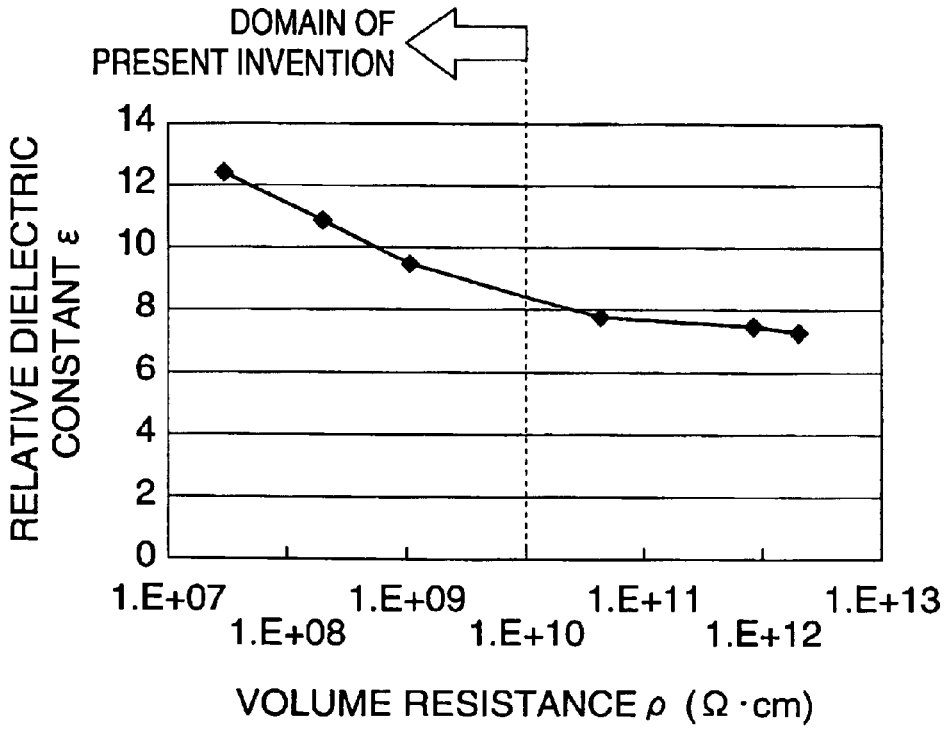
FIG. 12 is a graph showing the characteristic of the relative dielectric constant of the intermediate transfer belt to the volume resistance at the measurement voltage of 500 V.
Figure 13:
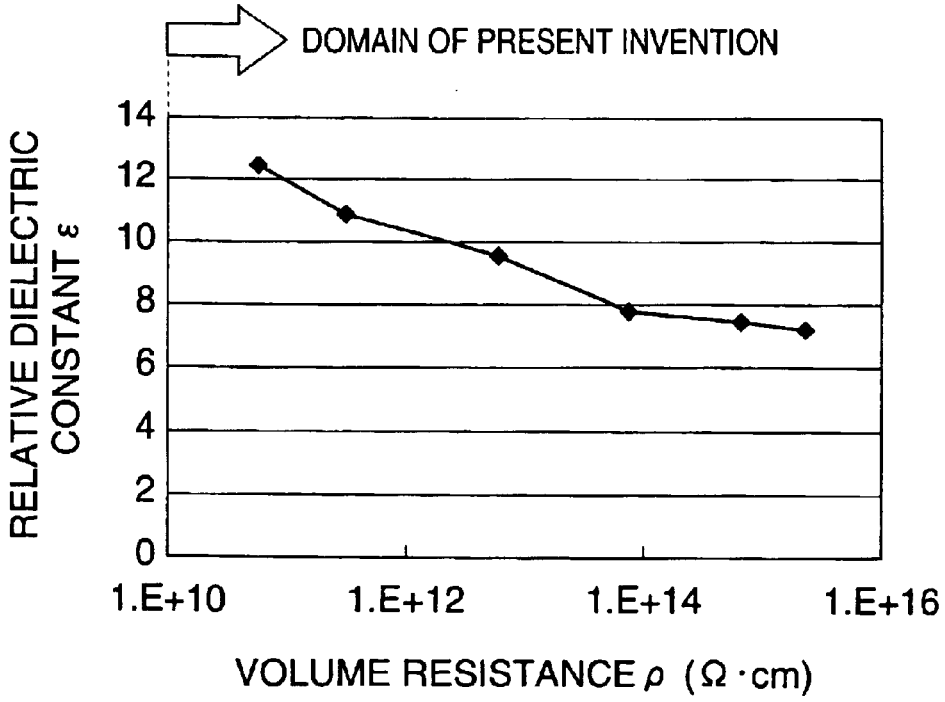
FIG. 13 is a graph showing the characteristic of the relative dielectric constant of the intermediate transfer belt to the volume resistance at the measurement voltage of 100 V.

The volume resistance ρ of the intermediate transfer belt is controlled by adding carbon to resin material such as polycarbonate resin. The relative dielectric constant ∈ is determined by the amount of carbon to be added to the resin. Then as the relative dielectric constant ∈ of the intermediate transfer belt within a range of excellent transfer efficiency, more particularly, within the range of 90% or higher transfer efficiency is as shown in FIGS. 12 and 13. FIG. 12 shows the result of measurement of the relative dielectric constant ∈ to the change of the volume resistance ρ measured at a measurement voltage of 500 V. The relative dielectric constant ∈ is 8 or greater when the volume resistance ρ is $10^{10}$ Ω·cm or lower. From this measurement result, the range of the relative dielectric constant ∈ is 8 or greater in the present invention. Further, FIG. 13 shows the result of measurement of the relative dielectric constant ∈ within a range for the excellent 90% or higher transfer efficiency to the change of the volume resistance ρ measured at a measurement voltage of 100 V. In this case, the relative dielectric constant ∈ is 8 or greater within a range of the volume resistance ρ of $10^{10}$ to $10^{14}$ Ω·cm.

Figure 14:
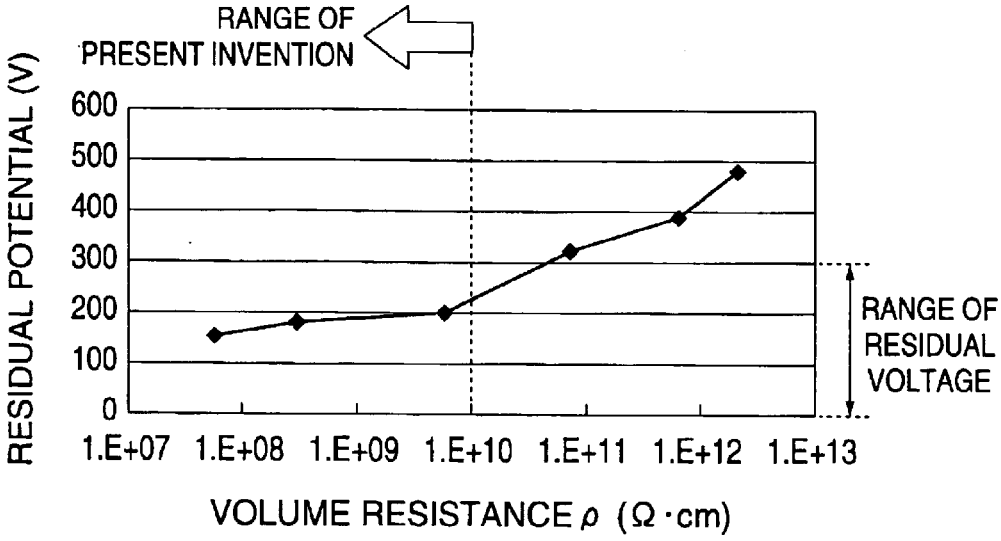
FIG. 14 is a graph showing the characteristic of a residual potential of the intermediate transfer belt to the volume resistance.

FIG. 14 shows the result of measurement of the residual voltage after the elapse of time t1=0.923 ms when the transfer voltage of 1000 V to the voltage resistance ρ obtained at the measurement voltage of 500 V in FIG. 12 has been applied and the intermediate transfer belt has been moved by a distance 84 mm as an interval between drums at a belt conveyance speed of 91 mm/s. In this case, the residual voltage necessary for the intermediate transfer belt is 300 V or lower, and preferably, about 100 V. It is understood that the optimum range that the volume resistance ρ of the intermediate transfer belt is $10^{10}$ Ω·cm or lower at 500 V satisfies the condition that the residual voltage is 300 V or lower.

Next, assuming that the distance between the photoconductor drums is L and a process speed as the belt conveyance speed is v, after the primary transfer of one of the yellow, magenta, cyan, black toner images, the next transfer is performed after elapse of time t1=L/v. In this case, the charge accumulated on the intermediate transfer belt during the time t1 before the next transfer is sufficiently attenuated, and must be, e.g., 300 V or lower.

Figure 15:
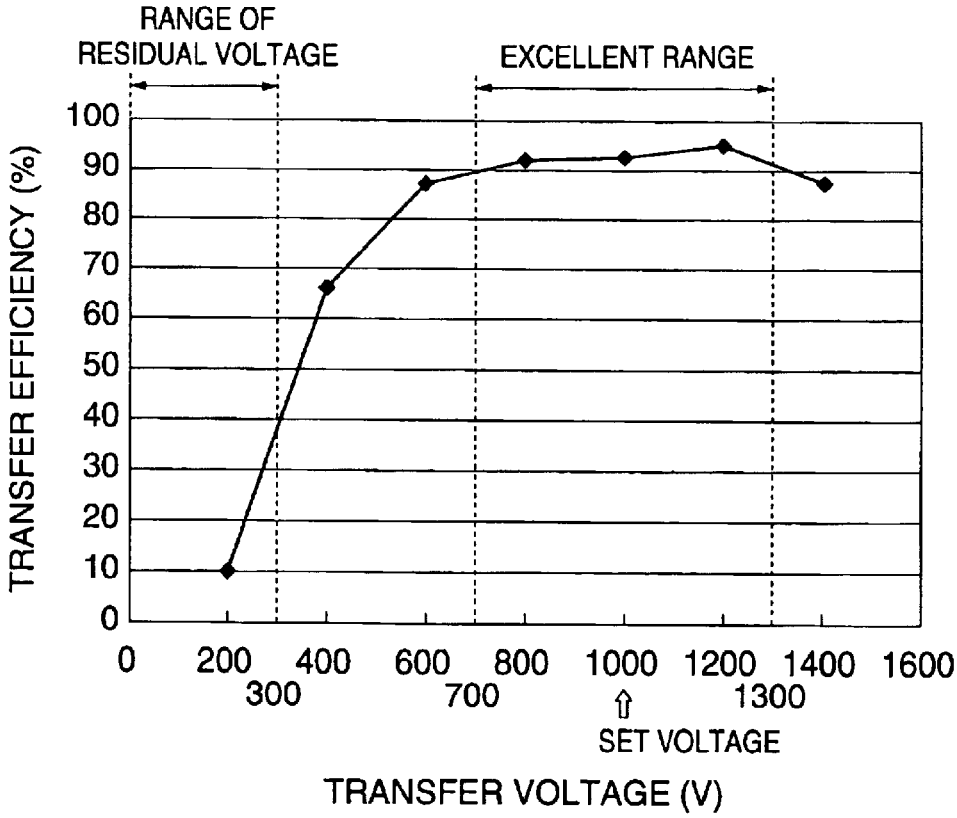
FIG. 15 is a graph showing the characteristic of transfer efficiency of the intermediate transfer belt to a transfer voltage.

FIG. 15 shows the result of measurement of the relation between the transfer voltage and the transfer efficiency upon the primary transfer. If the excellent transfer efficiency is set to 90% from this measurement result, the transfer voltage for the excellent transfer efficiency is within the range of 700 to 1300 V. If the transfer voltage is set to 1000 V, even if the residual voltage exists upon second or the subsequent transfer, as a minimum necessary effective voltage is 700 V, excellent transfer is performed within the range of the residual voltage of ±300 V. However, in the actual intermediate transfer belt, to hold charge in the next transfer position, 300 V or lower, or more preferably, about 100 V potential is necessary. Accordingly, the range of −300 V is excluded. As long as the residual voltage is 300 V or lower after the time t1 from the attenuation characteristic curve 66 in FIG. 9, even if all the primary transfer voltage is supplied from the same power source, 90% or higher excellent transfer efficiency can be attained.

In the color printer in FIGS. 5 and 7, in an experiment where L=84 mm holds as the interval of the photoconductor drums 14-1 to 14-4, and the process speed v is 91 mm/s, t1=0.923 holds. In the attenuation characteristic curve 66 in FIG. 9, during time t1=0.923 ms, the residual voltage is about 250 V, and sufficient attenuation characteristic is obtained. When the residual voltage is 250 V, the surface resistance S is $1\times10^{11}$ Ω/□ from FIG. 10. In this case, mutual influence on the photoconductor drums can be prevented and excellent image quality can be obtained. Further, roller resistance of the intermediate transfer rollers 38-1 to 38-4 at this time is $10^{6}$Ω.

Figure 16:
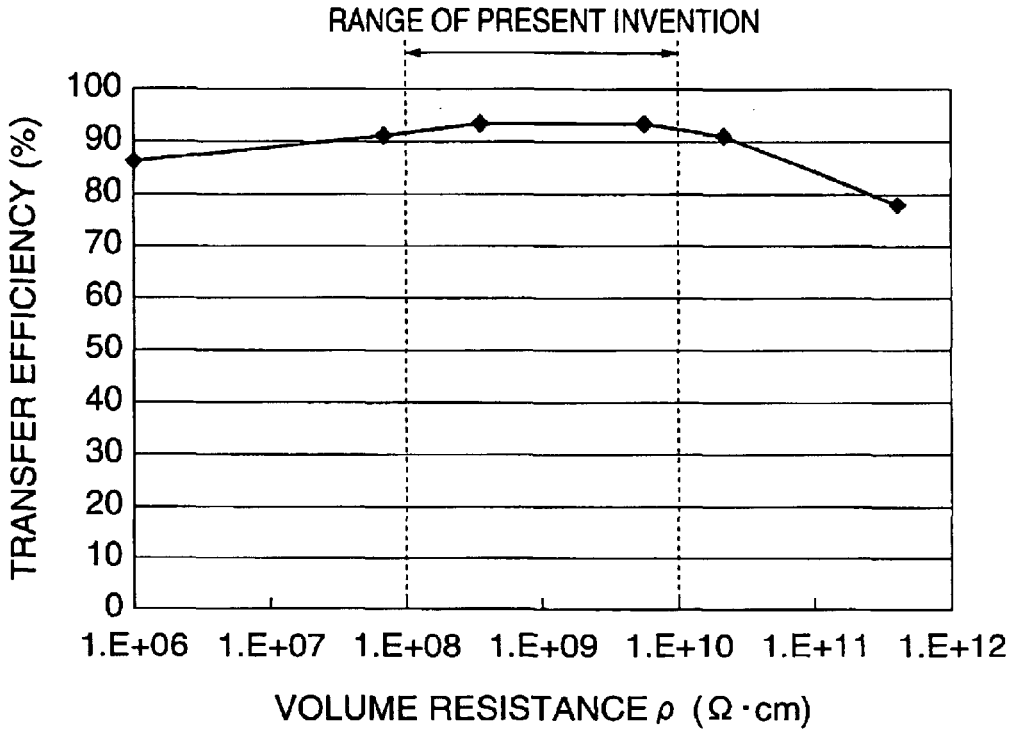
FIG. 16 is a graph showing the characteristic of the transfer efficiency of the intermediate transfer belt to the volume resistance.

FIG. 16 shows the relation between the volume resistance and the transfer efficiency in a case where the volume resistance ρ, the surface resistance S and the relative dielectric constant ∈ of the intermediate transfer belt are set within optimum areas, regarding yellow and black transfer when the transfer voltage is set to 1000 V. It is understood from the characteristic of the measurement result that the transfer efficiency is lowered if the volume resistance is increased to accumulate charge.

Figure 17:
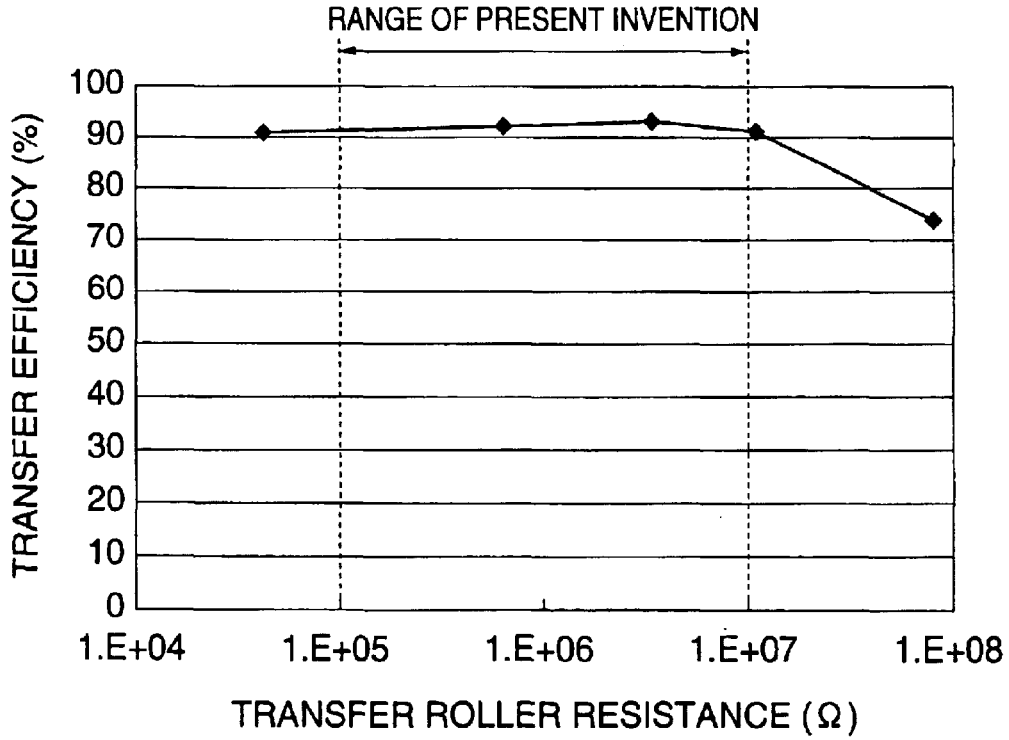
FIG. 17 is a graph showing the characteristic of the transfer efficiency to a resistance of a transfer roller.

FIG. 17 shows the result of measurement of the relation between the resistance of the intermediate transfer rollers 38-1 to 38-4 and the transfer efficiency. It is understood from the measurement result that the range of the resistance of the transfer rollers for 90% or higher excellent transfer efficiency is $10^{4}$ to $10^{7}$Ω. Accordingly, in the present invention, the optimum range of the resistance of the intermediate transfer rollers 38-1 to 38-4 is $10^7\Omega$ or lower. Note that if the resistance of the intermediate transfer rollers is $10^5\Omega$ or lower, image quality is poor and toner dispersion occurs in transfer. Accordingly, it is preferable that the optimum value of the resistance of the intermediate transfer roller is within the range of $10^5$ to $10^7\Omega$.

Figure 18:
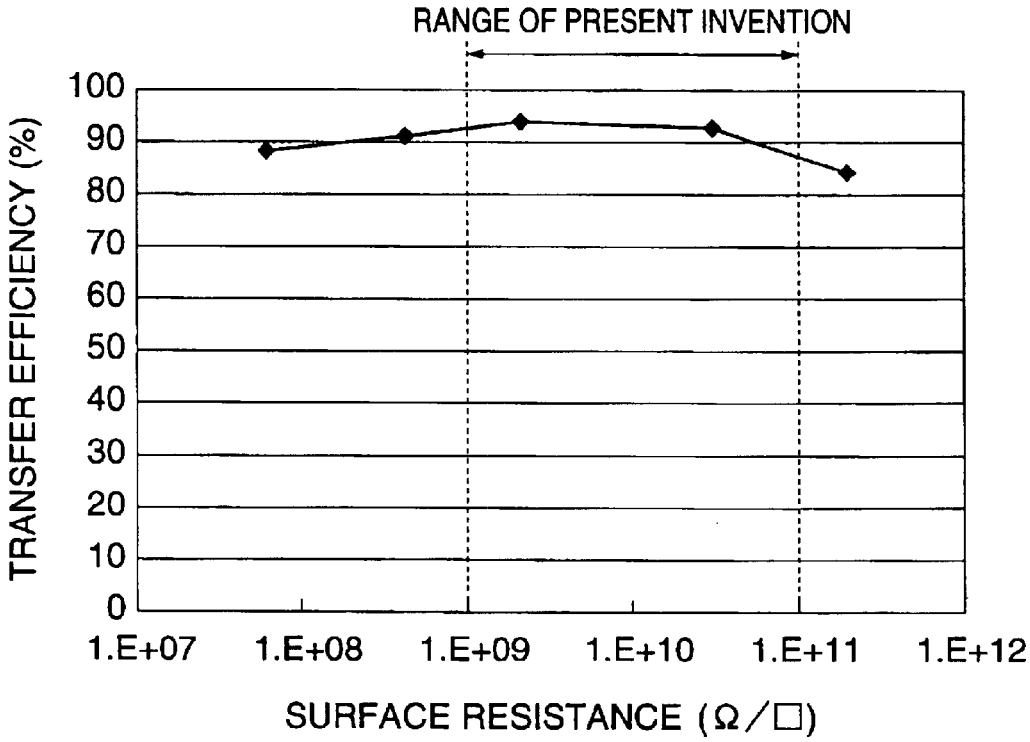
FIG. 18 is a graph showing the characteristic of the transfer efficiency to the surface resistance of the intermediate transfer belt.

FIG. 18 shows the result of measurement of the relation between the surface resistance S and the transfer efficiency in the intermediate transfer belt. In accordance with the characteristic of the measurement result, the range of excellent 90% or higher transfer efficiency is set within the range of about $1\times10^9$ to $1\times10^{11}$ Ω/□. In the present invention, the optimum range is $1\times10^9$ to $1\times10^{11}$ Ω/□.

Figure 19:
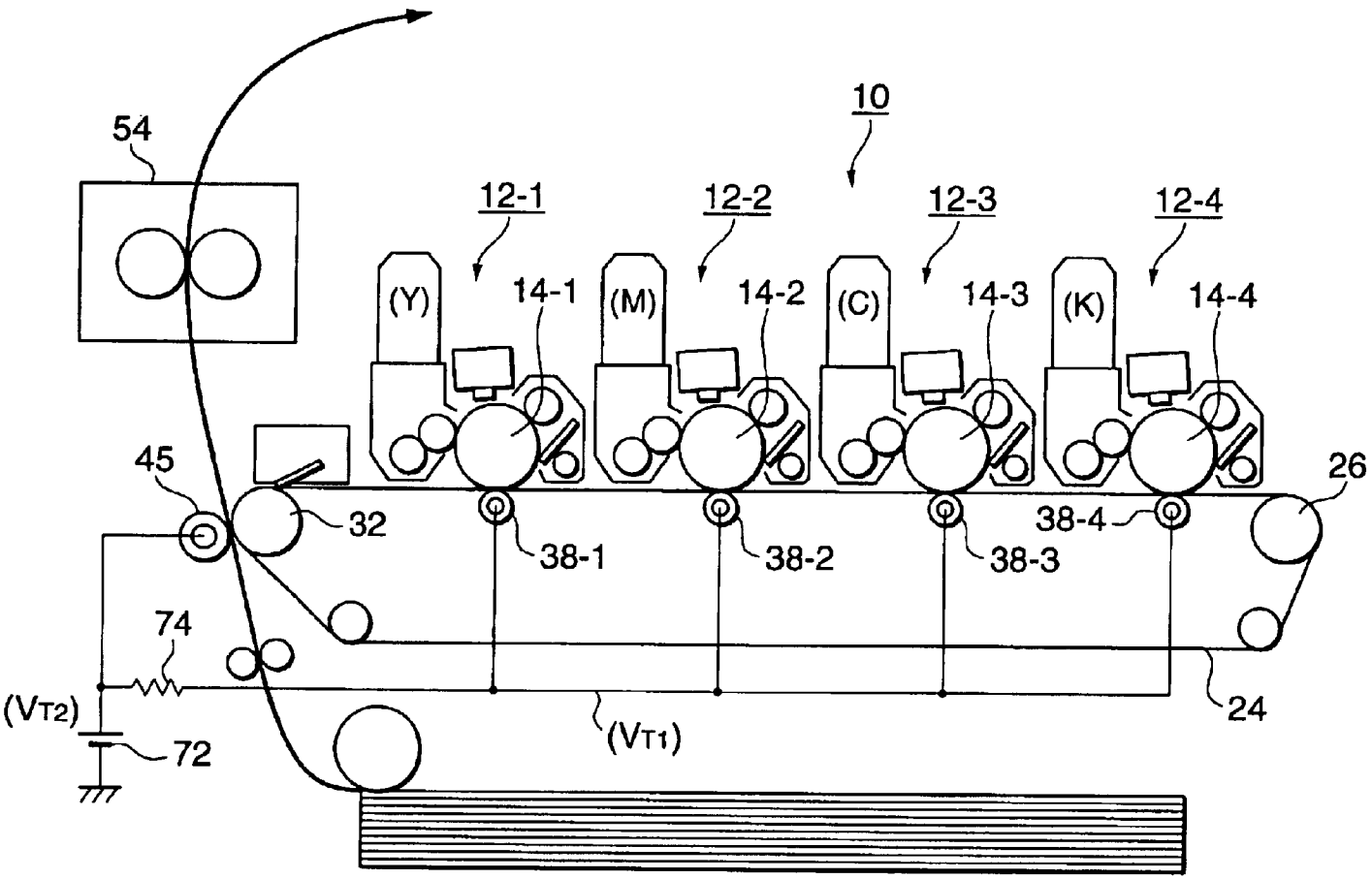
FIG. 19 is a schematic cross-sectional view showing the image forming apparatus according to another embodiment of the present invention in which commonality of a power source is realized for primary transfer and secondary transfer.

FIG. 19 is a schematic cross-sectional view showing the image forming apparatus according to another embodiment of the present invention in which commonality of power source is realized for the primary transfer and the secondary transfer. In FIG. 19, in the color printer 10, the image forming units 12-1 to 12-4 having the photoconductor drums 14-1 to 14-4 are sequentially arrayed along a running direction of the intermediate transfer belt 24, and the intermediate transfer rollers 38-1 to 38-4 using sponge rollers are provided in positions opposite to the photoconductor drums 14-1 to 14-4 via the intermediate transfer belt 24 therebetween. Further, the paper transfer roller 45 for the secondary transfer is provided to be opposite to the backup roller 32 on the left side of the intermediate transfer belt 24 with the intermediate transfer belt 24 therebetween. In this embodiment, the primary transfer voltage to the intermediate transfer rollers 38-1 to 38-4 and the secondary transfer voltage to the paper transfer roller 45 are supplied from the same power source 72. That is, the plus side of the power source 72 is directly connected to the paper transfer roller 45, and at the same time, the power source 72 is connected via a resistor 74 for voltage drop to the intermediate transfer rollers 38-1 to 38-4. In this arrangement, the secondary transfer voltage $V_{T2}$ is applied to the paper transfer roller 45 from the power source 72, and the primary transfer voltage $V_{T1}$, obtained by reducing the secondary transfer voltage $V_{T2}$ in the resister 74 by a predetermined voltage, is supplied to the intermediate transfer rollers 38-1 to 38-4. The secondary transfer voltage $V_{T2}$ is, e.g., 2000 V, and the primary transfer voltage $V_{T1}$ voltage-dropped by the resistor 74 is, i.e., 1000 V.

Figure 20:
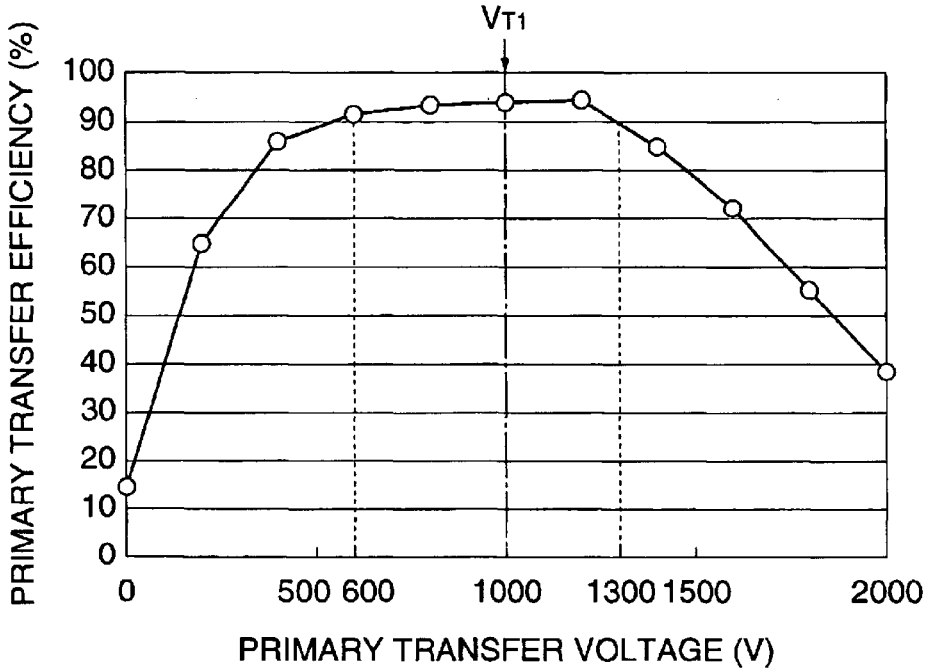
FIG. 20 is a graph showing the characteristic of primary transfer efficiency to a primary transfer voltage in FIG. 19.

FIG. 20 shows the result of measurement of the primary transfer efficiency to the intermediate transfer belt 24 when the primary transfer voltage $V_{T1}$ to the intermediate transfer rollers 38-1 to 38-4 is changed. The primary transfer efficiency is defined as the percentage of the amount of toner transferred onto the intermediate transfer belt to the amount of toner adhesion in a solid image on the photoconductor drum prior to the transfer. In this transfer efficiency, 90% or higher percentage is determined as excellent transfer efficiency. In FIG. 20, the primary transfer efficiency is 90% or higher within the range of 600 V to 1300 V. One point of this range is set, as the primary transfer voltage $V_{T1}$, to e.g. 1000 V.

To form a color image, it is desirable that the primary transfer efficiency has the same voltage characteristic for the respective colors since transfer of plural colors can be performed by use of the same voltage i.e. the single power source and the cost of the power source can be reduced. In the embodiment as shown in FIG. 19, as the positions of the intermediate transfer rollers 38-1 to 38-4 to transfer nips as contact points of the photoconductor drums 14-1 to 14-4 are the same, the voltage characteristics of the transfer efficiencies for the respective colors show almost the same tendency. As a result, application of transfer voltage from a single power source is realized. Substantially, the above advantages are attained if variation of effective transfer voltage in the transfer nips as belt contact points of the respective-color photoconductor drums 14-1 to 14-4 stands within a voltage margin of the transfer efficiency and the voltage margins for the respective colors overlap with each other.

Figure 21:
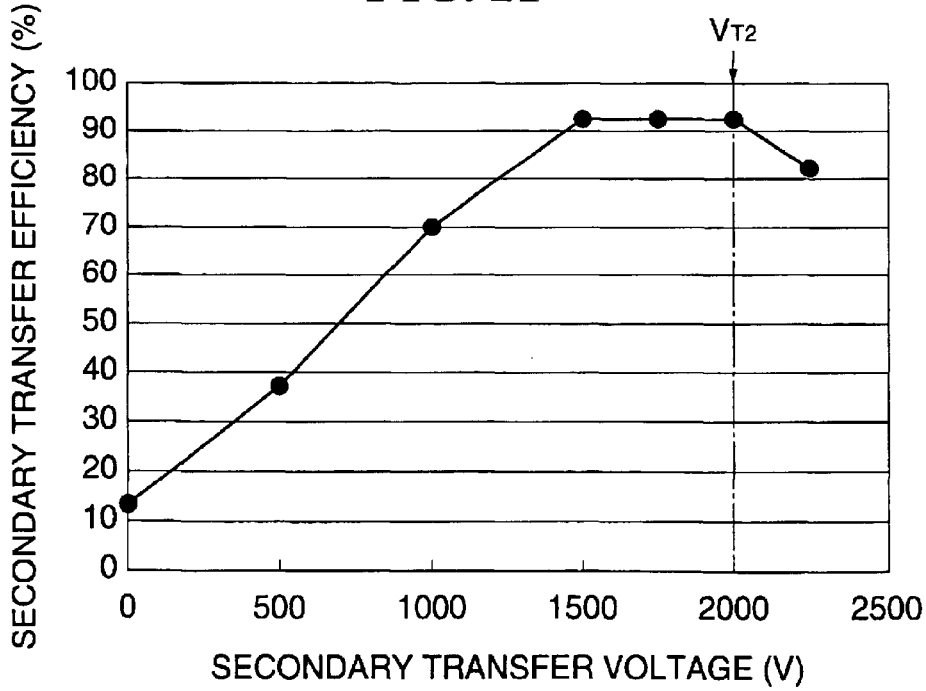
FIG. 21 is a graph showing the characteristic of secondary transfer efficiency to a secondary transfer voltage in FIG. 19.

FIG. 21 shows the secondary transfer efficiency to the change of the secondary transfer voltage applied to the paper transfer roller 45 in the embodiment in FIG. 19. The secondary transfer efficiency is defined as the percentage of the amount of toner transferred onto a print medium such as a print sheet to the amount of toner adhesion in a solid image on the intermediate transfer belt 24 prior to the transfer. Also in this transfer efficiency, 90% or higher percentage is determined as an excellent transfer. In FIG. 21, the secondary transfer efficiency is 90% or higher within the range of 1500 V to 2000 V. The secondary transfer voltage is set to one point of this range, e.g., 2000 V. In accordance with the characteristics in FIGS. 20 and 21, the secondary transfer voltage 2000 V is supplied by constant voltage control in the power source 72, and the voltage to the primary transfer voltage of 1000 V is reduced by the resistor 74.

Figure 22:
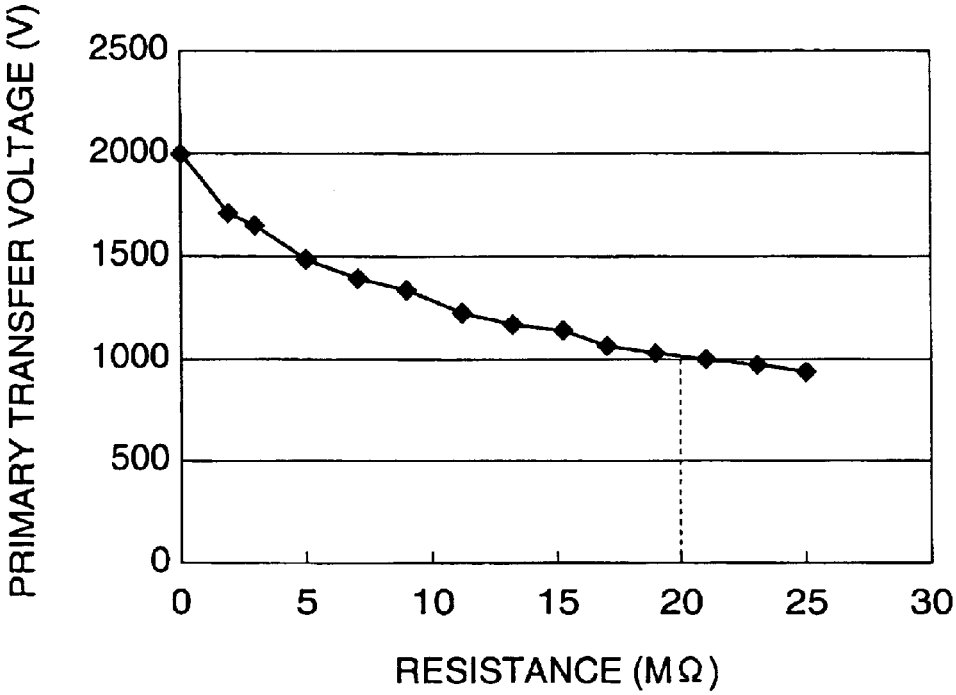
FIG. 22 is a graph showing the characteristic of the primary transfer voltage to a resistance value in FIG. 19.

FIG. 22 shows the primary transfer voltage in a case where the resistance value of the resistor 74 in FIG. 19 is changed while the secondary transfer voltage of 2000 V is supplied. If the resistance value is set to 20 MΩ from the characteristic curve, the secondary transfer voltage of 2000 V can be reduced to the primary transfer voltage of 1000 V.

Note that in the embodiment in FIG. 19, the constant-voltage control is performed in the power source 72, however, as long as an optimum effective transfer voltage can be obtained by providing the resistor 74, the constant-voltage control is not necessarily performed. As the voltage drop to obtain the primary transfer voltage is determined by the resistance value of the resistor 74, constant-current control is performed in the power source 72.

Figure 23:
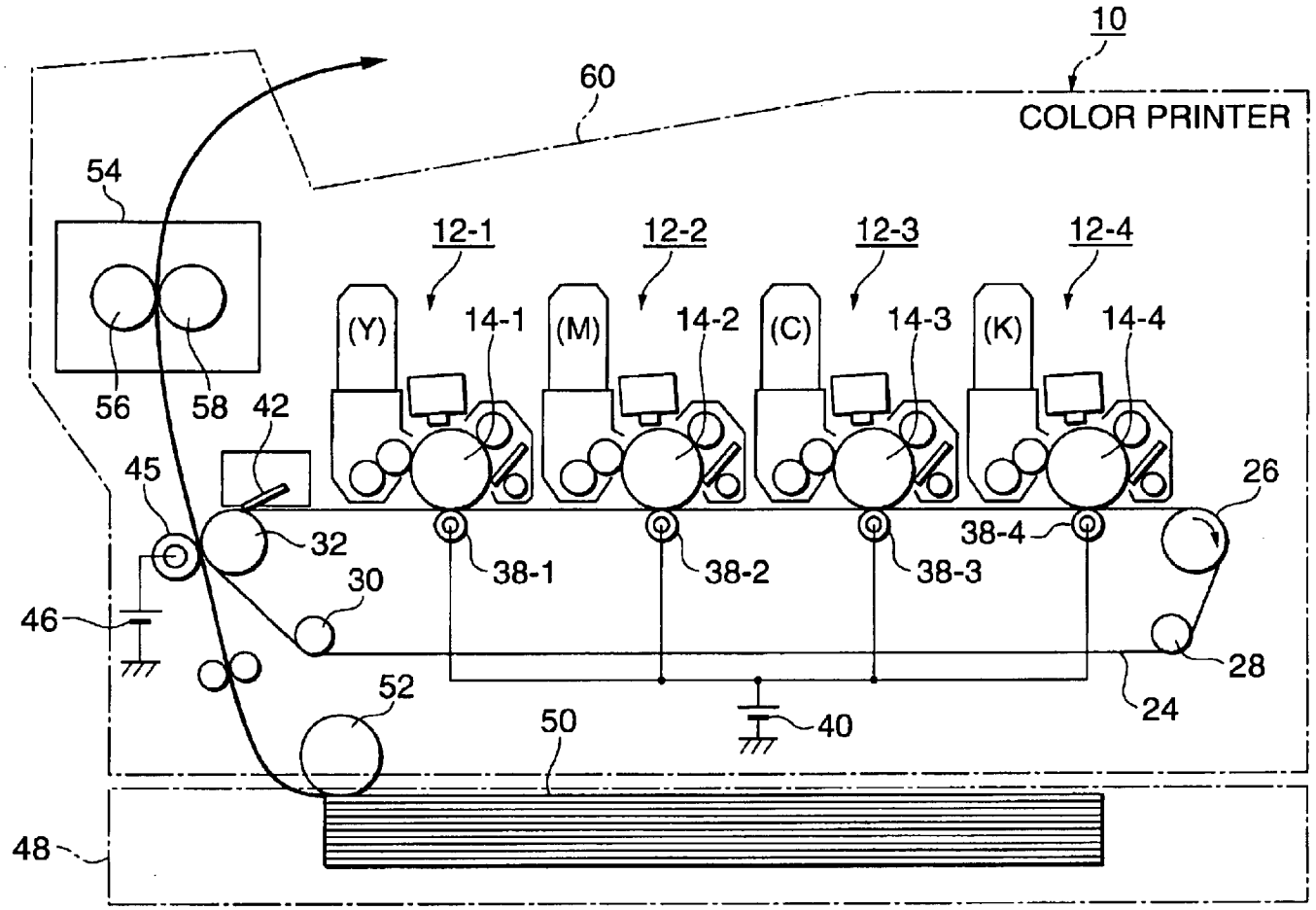
FIG. 23 is a schematic cross-sectional view showing the image forming apparatus according to another embodiment of the present invention in which an optimum effective transfer voltage is set for a transfer nip of a photoconductor drum based on a transfer roller resistance value.

FIG. 23 is a schematic cross-sectional view showing a color printer as the image forming apparatus according to another embodiment of the present invention in which an optimum effective transfer voltage is set for a transfer nip of the photoconductor drum based on the resistance value of the transfer roller. In FIG. 23, in the color printer 10, the intermediate transfer belt 24 is placed around the drive roller 26, the tension rollers 28, 30 and the backup roller 32, and the image forming units 12-1 to 12-4 are arrayed on an upper part of the intermediate transfer belt 24 along the belt conveyance direction. The image forming units 12-1 to 12-4 have the photoconductor drums 14-1 to 14-4. The intermediate transfer rollers 38-1 to 38-4 to which the primary transfer voltage is applied are provided on the opposite side to the photoconductor drums via the intermediate transfer belt 24. Further, the paper transfer roller 45 for the secondary transfer onto a print sheet 52 fed by a pickup roller 52 is provided on the opposite side to the backup roller 32 via the intermediate transfer belt 24. The print sheet onto which the secondary transfer has been performed is subjected to fixing by heat-adhesion of developers by a fixer 54, and then discharged onto a stacker 60.

Figure 24A:
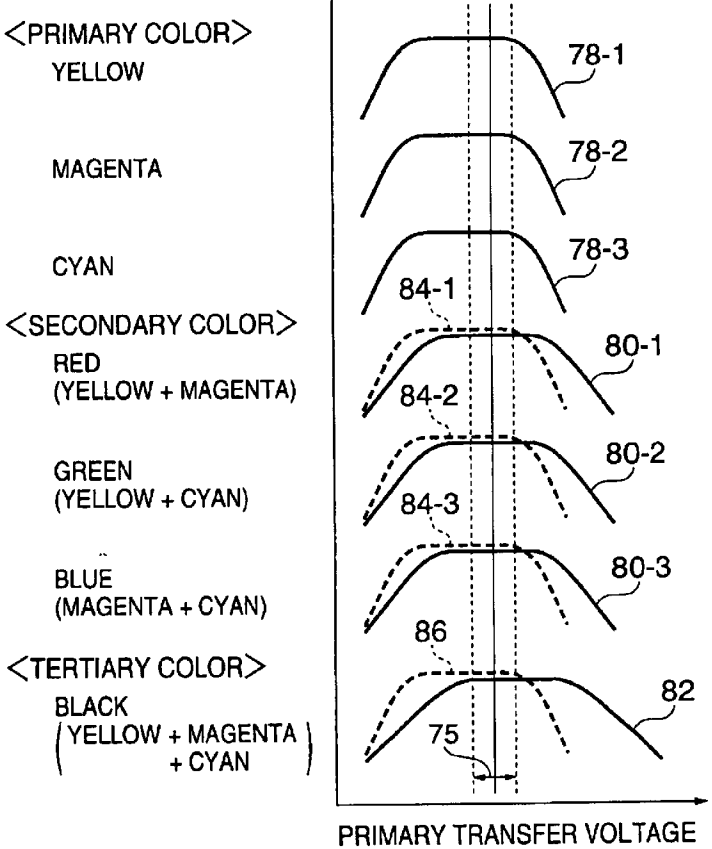
FIGS. 24A and 24B are an explanatory view showing the characteristics of the primary transfer efficiency to the primary transfer voltage in FIG. 23 and a comparative example.
Figure 24B:
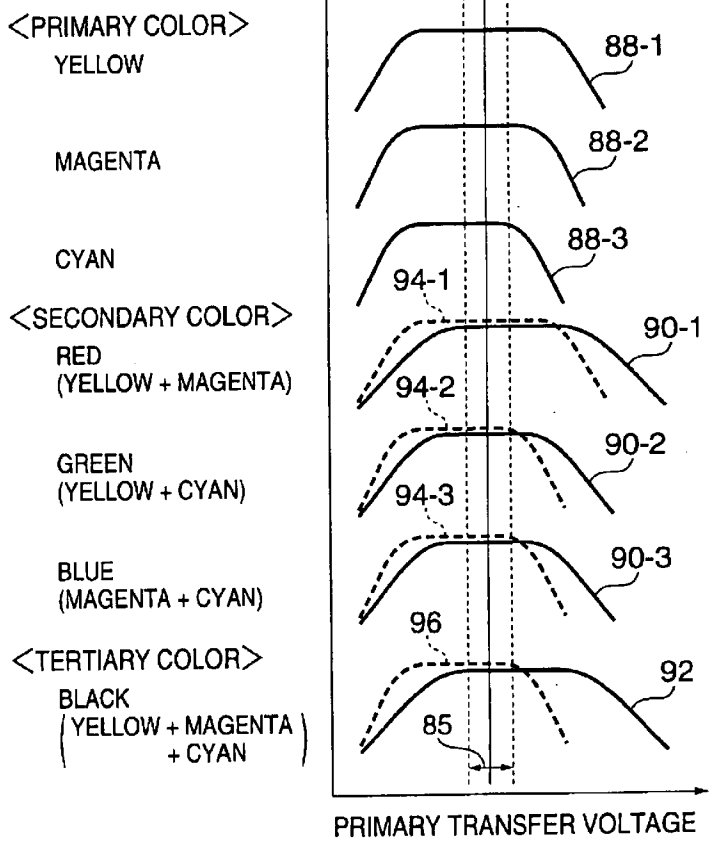

Note that the same transfer voltage from a common power source 40 is applied to the intermediate transfer rollers 38-1 to 38-4. The resistance values of the intermediate transfer rollers 38-1 to 38-4 are different such that the effective transfer voltage, applied to the transfer nips of the photoconductor drums 14-1 to 14-4, is higher for a downstream side transfer portion where the number of overlaid colors is larger, whereas the effective transfer voltage is lower for an upstream side transfer portion where the number of overlaid color is smaller. To realize optimization of effective transfer voltage to the transfer portions with different numbers of overlaid colors, the resistance values of the intermediate transfer rollers 38-1 to 38-4 are set such that the resistance value is higher for an upstream transfer portion where the number of overlaid colors is smaller whereas the resistance value is lower for an upstream transfer portion where the number of overlaid colors is larger. FIGS. 24A and 24B show the transfer efficiencies of the respective colors to changes of the primary transfer voltage in the embodiment of the present invention, in which the effective transfer voltage applied to the transfer nip is higher in a transfer portion where the number of overlaid colors is larger, and a comparative example where the same effective transfer voltage is applied to all the transfer portions. That is, FIG. 24A shows the comparative example of the transfer efficiencies of the respective colors to the primary transfer voltage in a case where the effective transfer voltage is constant even though the number of overlaid colors is increased. FIG. 24B shows the transfer efficiencies of the respective colors to changes of the primary transfer voltage in the embodiment of the present invention in a case where the effective transfer voltage applied to the transfer nip is higher in a transfer portion where the number of overlaid colors is larger.

First, the comparative example 24A shows primary-color characteristics 78-1 to 78-3 of yellow, magenta and cyan, a secondary-color characteristic 80-1 of red obtained by overlaying magenta on yellow, 80-2 of green obtained by overlaying cyan on yellow and 80-3 of blue obtained by overlaying cyan on magenta, further, a tertiary-color characteristic 82 of black obtained by overlaying magenta and cyan on yellow. In the transfer efficiency characteristics of the primary to tertiary colors to the primary transfer voltage in the comparative example, a voltage margin 75 of the primary transfer efficiency is determined by the characteristic 78-3 of cyan as the final primary color and the characteristic 82 of black as the tertiary color. That is, the constant-voltage side boundary of the voltage margin 75 is determined by the trailing edge of the transfer efficiency of the characteristic 82 of the tertiary black color, and on the other hand, the high-voltage side boundary of the voltage margin 75 is determined by the trailing edge of the characteristic 78-3 of the final primary cyan color. With respect to the voltage margin 75 in the comparative example, in the primary and secondary color characteristics 78-1 to 80-3, there is allowance in the low-voltage side voltage margin, however, in the tertiary color characteristic 82, there is not much allowance in the voltage-side margin. On the other hand, in the characteristics except the tertiary black characteristic 82, there is not much allowance in the high-voltage side margin. Particularly in the characteristic 78-1 of the first primary yellow color and the characteristic 78-2 of the second primary magenta color, there is wide allowance on the constant-voltage side but there is only a little allowance on the high-voltage side.

On the other hand, in the case of FIG. 24B where the effective transfer voltage is increased for a transfer portion where the number of overlaid colors is large, according to the present invention, a common voltage margin 85 is determined by a characteristic 88-3 of cyan as the final primary color and a characteristic 92 of black as the tertiary color. As the effective voltage is lower in an upstream side transfer portion where the number of overlaid colors is small than in a downstream side transfer portion where the number of overlaid colors is large, the voltage margin of the transfer efficiency expands to the high-voltage side in a characteristic 88-1 of yellow as the first primary color and in a characteristic 88-2 of magenta as the second primary color. At the same time, the leading of the transfer efficiency on the low-voltage side is delayed, however, as the allowance on the constant-voltage side is initially large, no problem occurs. Since the common voltage margin 85 for primary to tertiary colors is determined by the characteristic 88-3 of the final primary cyan color and the characteristic 92 of the tertiary black color, the transfer characteristics of the respective colors except the final color are greatly stabilized in comparison with the voltage margin 75 in the comparative example.

Next, a description will be made about a particular example of the present embodiment in FIG. 23 where the resistance values of the intermediate transfer rollers 38-1 to 38-4 are different such that the resistance is lower as the number of overlaid colors is larger. In FIG. 23, the intermediate transfer rollers 38-1 to 38-4 for the primary transfer include a sponge roller having an outer diameter of 14 mm where a metal shaft having a diameter of 8 mm is covered with a carbon conductive sponge. The hardness of the sponge is about Asker C 40, and the pressure of the transfer nips with which the photoconductor drums 14-1 to 14-4 and the intermediate transfer belt 24 are brought into contact is linear load 20 to 30 g/cm. Further, the resistance of the sponge roller used in the intermediate transfer rollers 38-1 to 38-4 is measured as sponge line-width resistance upon application of a voltage of +1000 V while weight of 500 g is applied to the both ends of the roller shaft. The inventor of the present invention examined the voltage characteristic of the primary transfer efficiency using the sponge rollers with resistances of $10^4\Omega$, $10^6\Omega$ and $10^8\Omega$ as the intermediate transfer rollers 38-1 to 38-4. In this case, the primary transfer voltage is applied from the single power source 40. Further, the transfer efficiency is the percentage of amount of toner transferred onto the intermediate transfer belt to the amount of toner adhesion in a solid image on the photoconductor drum prior to the transfer. The transfer efficiency is determined as excellent when it is 90% or higher.

Figure 25A:
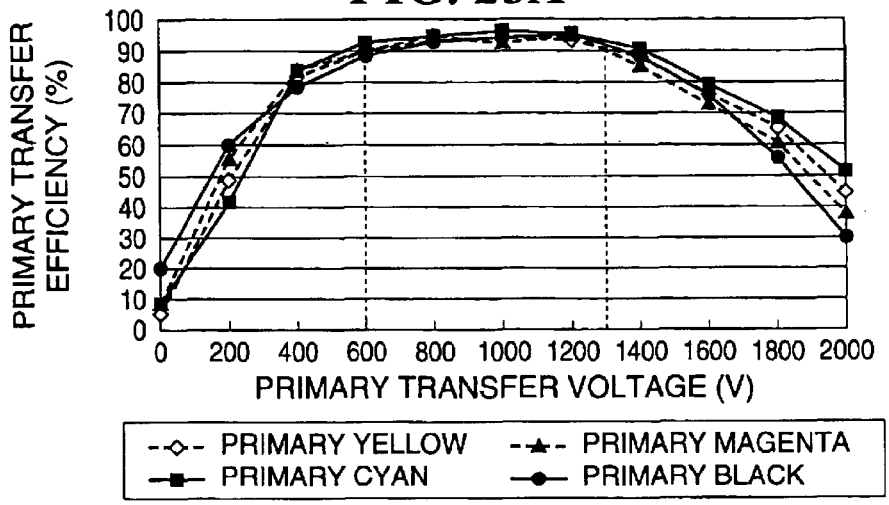
FIGS. 25A to 25C are graphs showing, as results of measurement, the characteristics of the primary transfer efficiency to the primary transfer voltage in FIG. 23.
Figure 25B:
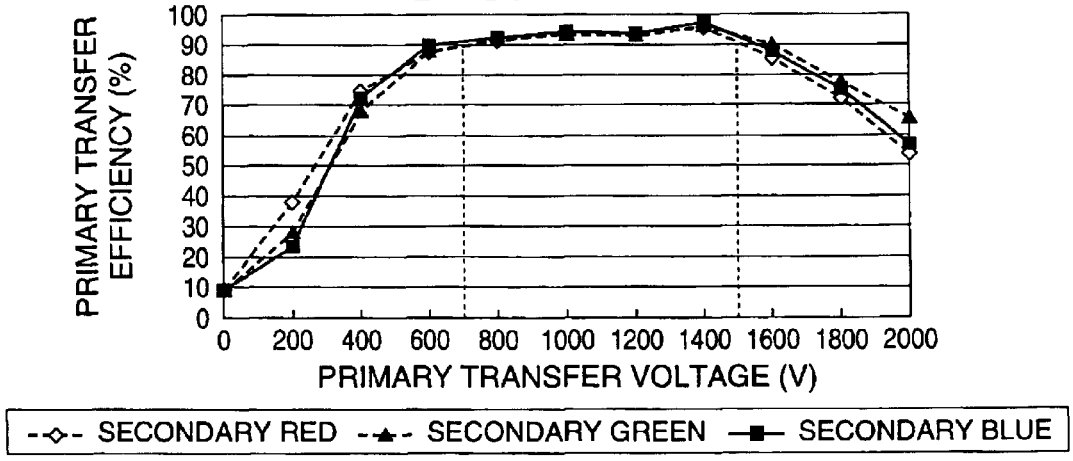
Figure 25C:
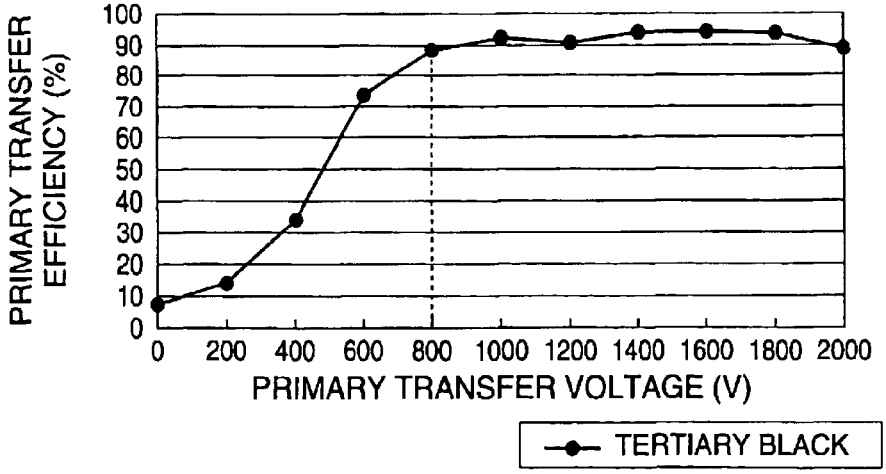
Figure 26:
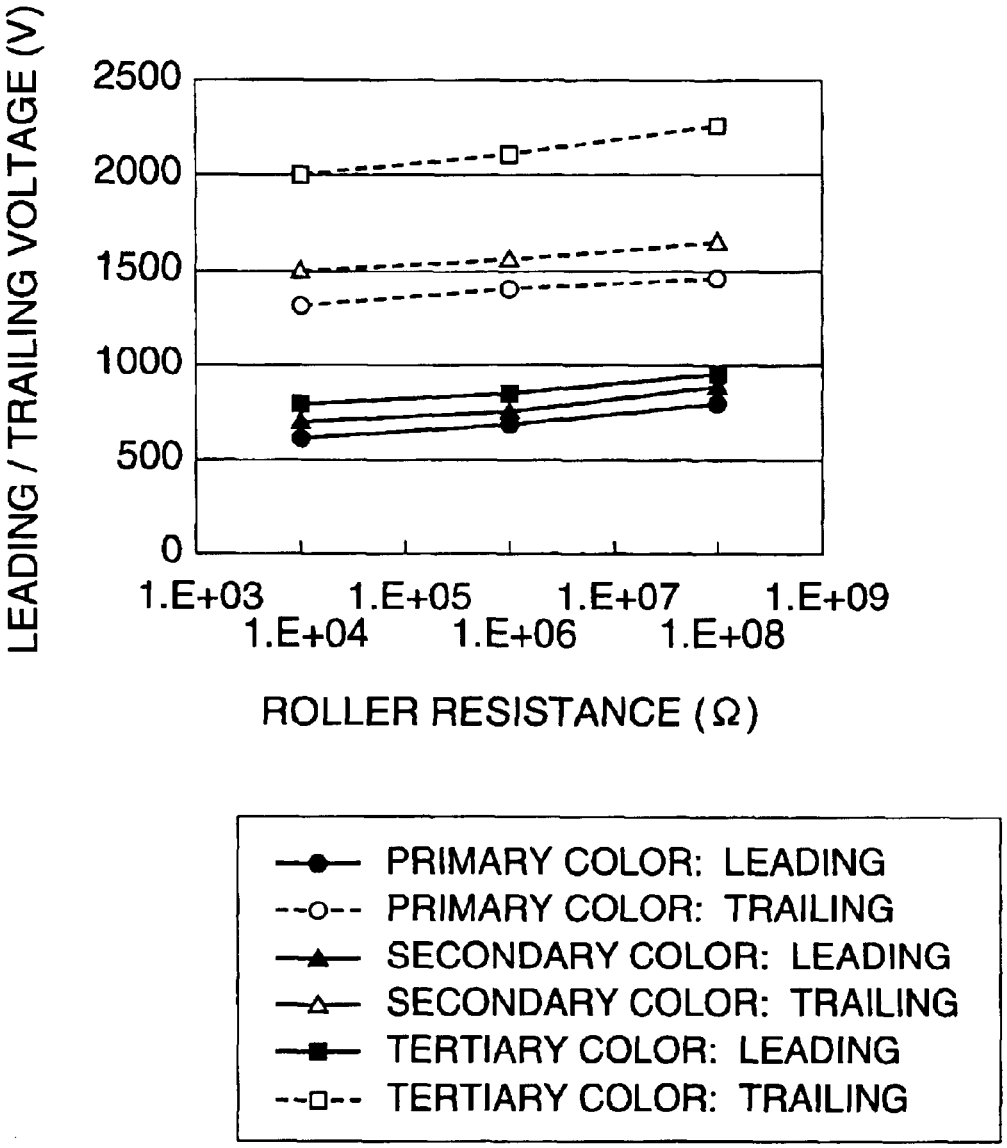
FIG. 26 is a graph showing the characteristics of leading voltages and trailing voltages at 90% transfer efficiency to a resistance of the transfer roller in FIG. 23.

FIGS. 25A to 25C show the result of measurement of the primary transfer efficiency to the primary transfer voltage for the respective primary to tertiary colors in a case where the sponge roller with the resistance of $10^4\Omega$ is used as the intermediate transfer rollers 38-1 to 38-4. That is, FIG. 25A shows the result of measurement of the primary transfer efficiency to the primary transfer voltage for yellow, magenta and cyan and black. As the image forming condition and the transfer condition for the respective colors are approximately the same, the transfer characteristics of the respective colors are similar to each other. FIG. 25B shows the primary transfer efficiencies to the primary transfer voltage for the secondary colors obtained by overlaying 2 colors. Also in this case, the image forming condition and the transfer condition for the respective colors are approximately the same, the transfer characteristics of the respective secondary colors are similar to each other. FIG. 25C shows the result of measurement of the primary transfer efficiency to the primary transfer voltage of the tertiary color obtained by overlaying yellow, magenta and cyan. When a comparison is made among the transfer characteristics of the primary, secondary and tertiary colors in FIGS. 25A to 25C, the leading voltage to the excellent transfer efficiency of 90% and trailing voltage therefrom are lowest 600 V (leading) and 1300 V (trailing) in the primary color characteristic in FIG. 25A, 700 V (leading) and 1500 V (trailing)

in the secondary color in FIG. 25B where the number of overlaid colors is increased, and 800 V (leading) in the tertiary color in FIG. 25C where the number of overlaid colors is the largest. Thus, the transfer characteristic is shifted to the high-voltage side as the number of overlaid colors is increased. The inventor examined the transfer efficiency to the changes of transfer voltage for the primary, secondary and tertiary colors as in the case of FIGS. 25A to 25C with respect to the sponge rollers with the resistances of $10^6\Omega$ and $10^8\Omega$, and determined the leading voltages and the trailing voltages to the 3 types of sponge rollers with resistances of $10^4\Omega$, $10^6\Omega$ and $10^8\Omega$, as shown in FIG. 26.

From the result of examination, as optimum sponges as the respective color intermediate transfer rollers 38-1 to 38-4, the sponge roller with the resistance of $10^6\Omega$ is desirable as the yellow, magenta and black intermediate transfer rollers 38-1, 38-2 and 38-4, and the sponge roller with the resistance of $10^4\Omega$ is desirable as the cyan intermediate transfer roller 38-3.

Figure 27A:
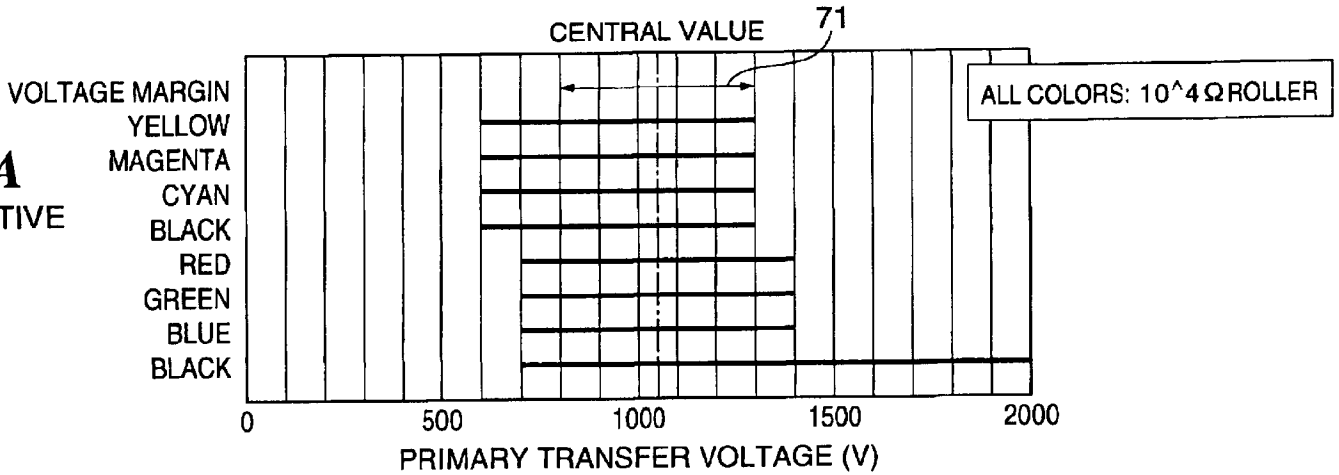
FIGS. 27A and 27B are a graph showing the characteristics of 90% or higher transfer efficiency to the primary transfer voltage in FIG. 23 and a graph of a comparative example.
Figure 27B:
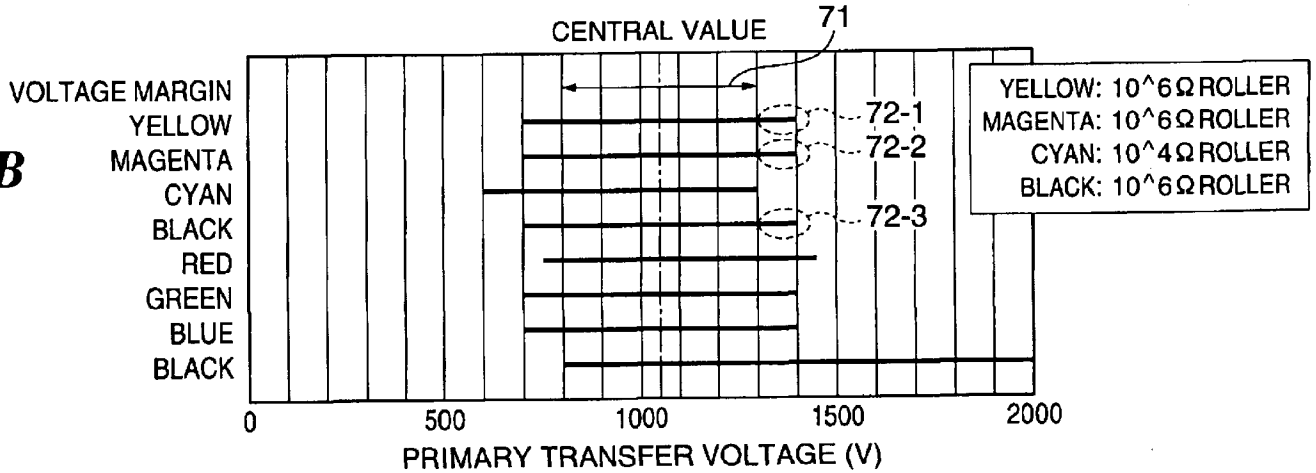

FIGS. 27A and 27B show the primary transfer voltage and voltage margins for 90% or higher transfer efficiency in the case where the sponge roller with the resistance of $10^4\Omega$ is used for all the colors and in the case where the sponge roller with the resistance of $10^6\Omega$ is used for yellow, magenta and black and the sponge roller with the resistance of $10^4\Omega$ is used for cyan, as optimum combinations. FIG. 27A shows the case of the sponge roller with the resistance of $10^4\Omega$ for all the colors, and as a comparative example, FIG. 27B shows the case of the sponge roller with the resistance of $10^6\Omega$ for yellow, magenta and black and the sponge roller with the resistance of $10^4\Omega$ for cyan, as optimum combinations.

First, a common voltage margin 71 in the comparative example of FIG. 27A and the optimum example of FIG. 27B stands within a leading voltage of 800 V to a trailing voltage of 1300 V determined by the final primary cyan color and the tertiary black color. The comparative example and the optimum example show the same voltage margin. Regarding the primary yellow, magenta and the tertiary black, as indicated by a dotted line in FIG. 27B, voltage margin portions 72-1 to 72-3 are expanded to the high-voltage side as compared with the comparative example. In the voltage margin for the primary colors, allowance is increased on the high-voltage side to the central voltage of 1100 V. In this manner, the transfer characteristics of the respective colors except the final transfer color can be further stabilized by optimization of the resistance values of the intermediate transfer rollers 38-1 to 38-4. Note that in the embodiment as shown in FIG. 23, the sponge rollers are used as the intermediate transfer rollers 38-1 to 38-4, however, other members such as a resistor brush or resistor sheet may be used in place of the intermediate transfer rollers. Further, the resistance values of these intermediate transfer electrode members are not limited to those in the embodiment in FIG. 23, and the values can be selected from a range to obtain a voltage margin for the 90% or higher transfer efficiency, based on the resistance value of the intermediate transfer belt 24, the printing speed, the amount of toner charging, the amount of toner adhesion, the primary transfer voltage and the like.

Figure 28:
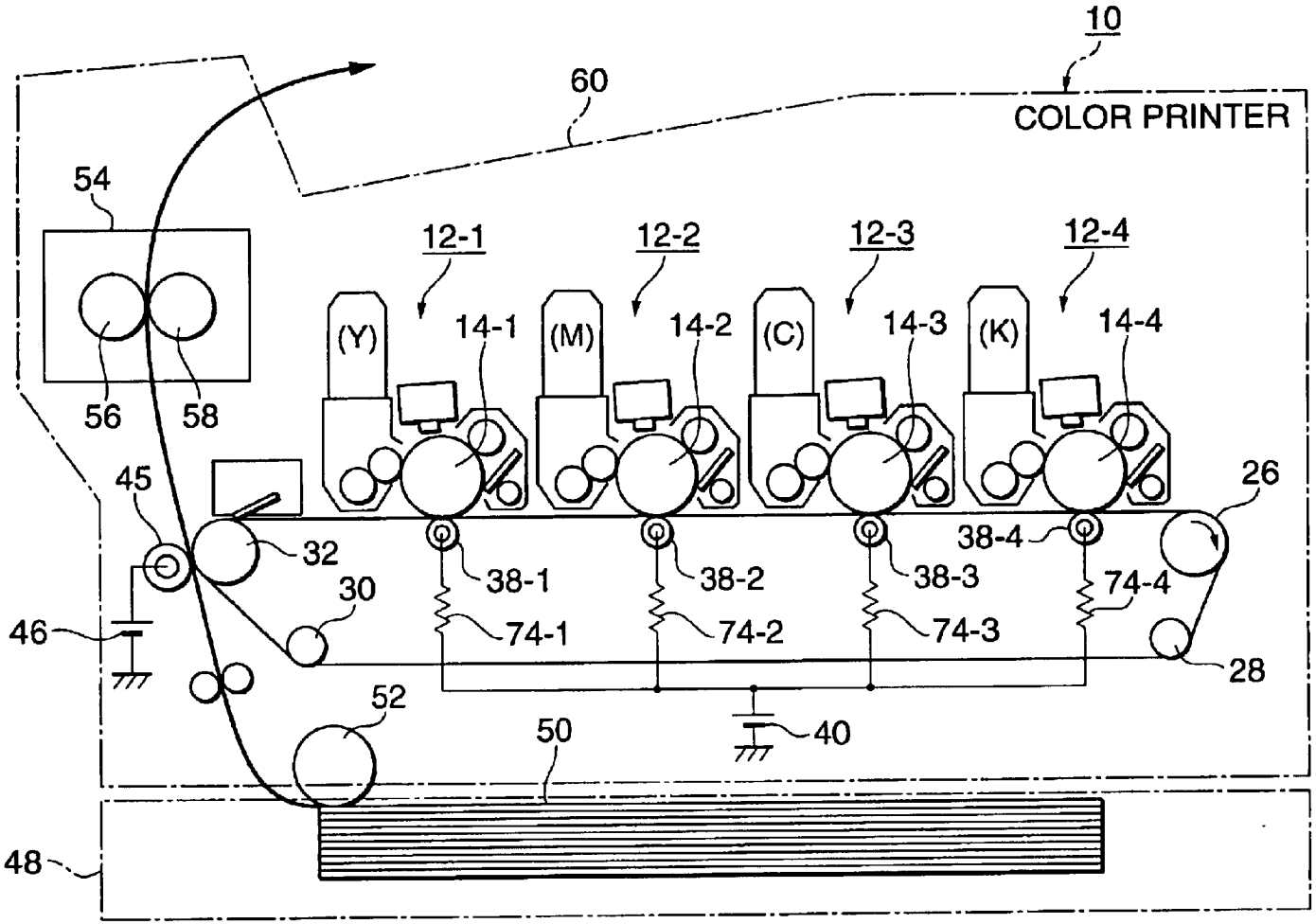
FIG. 28 is a schematic cross-sectional view showing the image forming apparatus according to an another embodiment of the present invention in which an optimum effective transfer voltage is set for the transfer nip of the photoconductor drum based on a resistance value of a compensation resistor.

FIG. 28 is a schematic cross-sectional view showing a color printer as the image forming apparatus according to another embodiment of the present invention in which an optimum effective transfer voltage is set for the transfer nip of the photoconductor drum based on a resistance value of a compensation resistor connected to a path from a common power source. In FIG. 28, the single-pass type construction of the color printer 10 is the same as that in FIG. 23, however, compensation resistors 74-1 to 74-4 are inserted in a path to supply the primary transfer voltage from the power source 40 to the intermediate transfer rollers 38-1 to 38-4. As the compensation resistors 74-1 to 74-4 have different resistance values, the effective transfer voltage applied via the intermediate transfer rollers 38-1 to 38-4 to the transfer nips as belt contacts with the respective color photoconductor drums 14-1 to 14-4 is increased in a transfer portion where the number of overlaid colors is larger. The sponge rollers having the resistance values of $10^4\Omega$ are used as the intermediate transfer rollers 38-1 to 38-4.

Figure 29:
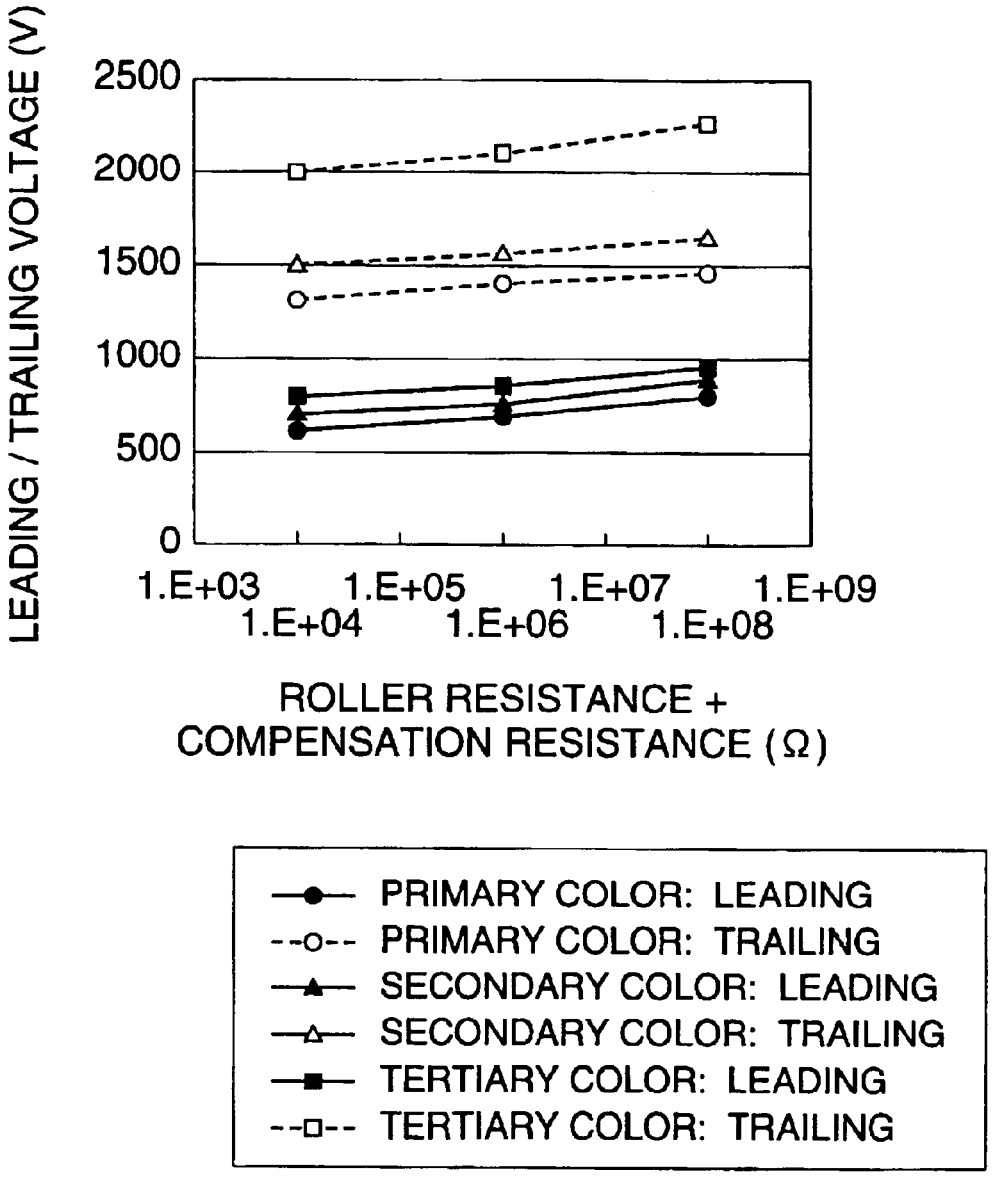
FIG. 29 is a graph showing the characteristics of the leading voltages and trailing voltages at 90% transfer efficiency to combined resistances of the transfer roller and the compensation resistor in FIG. 28.

FIG. 29 shows the leading and trailing voltages to changes of the resistance value obtained by adding the compensation resistance to the roller resistance as the voltage margins of the transfer efficiency of the primary to tertiary colors in the case where the compensation resistors 74-1 to 74-4 to be inserted in FIG. 28 have different resistance values. In consideration of these characteristics, as an optimum resistance value of the compensation resistors, a resistance value of 1 MΩ, for example, is set for the yellow, magenta and black compensation resistors 74-1, 74-2 and 74-4, and no resistance value is set for the cyan compensation resistor 74-3.

Figure 30A:
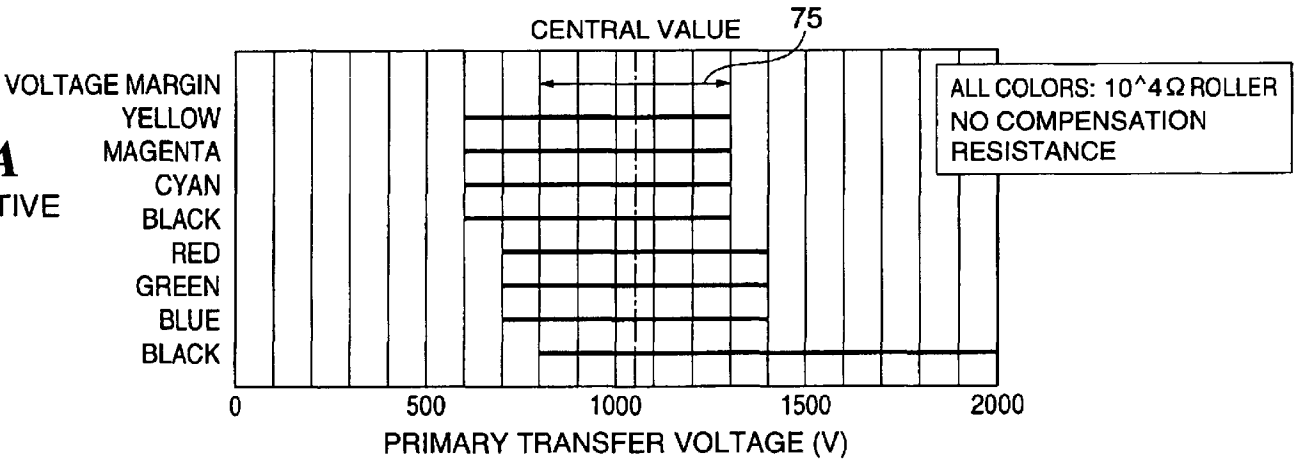
FIGS. 30A and 30B are a graph showing the characteristics of 90% or higher transfer efficiency to the primary transfer voltage in FIG. 28 and a graph of a comparative example.
Figure 30B:
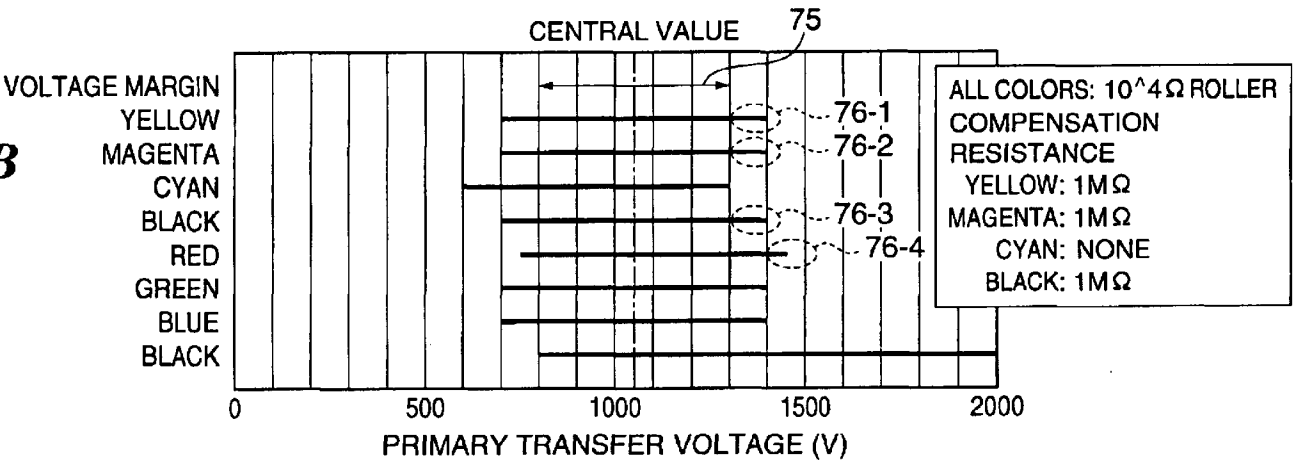

FIGS. 30A and 30B show the voltage margins of the primary transfer voltage for the primary, secondary and tertiary colors. FIG. 30A is a comparative example where all the sponge rollers not connected to compensation resistors have a resistance of $10^4\Omega$. FIG. 30B is an optimum example where the resistance 1 MΩ is selected for the compensation resistors for yellow, magenta and black colors also in the case where all the sponge rollers have a resistance of $10^4\Omega$. In the comparative example of FIG. 30A and the optimum example of FIG. 30B, a common voltage margin 75 is 800 V to 1300 V, however, in the optimum example, portions 76-1 to 76-3 are expanded to the high-voltage side regarding the primary yellow, magenta colors and the tertiary black color. Further, regarding the secondary red color, a portion 76-4 is slightly expanded to the high-voltage side. As a result, especially in the primary-color voltage margins, the allowance is further increased on the high-voltage side to the central voltage of 1100 V. In this manner, the resistance values of the compensation resistors provided in the circuit are optimized in a case where the transfer voltage is applied to the intermediate transfer rollers, the transfer characteristics of the respective colors except the final transfer color can be further stabilized.

Figure 31:
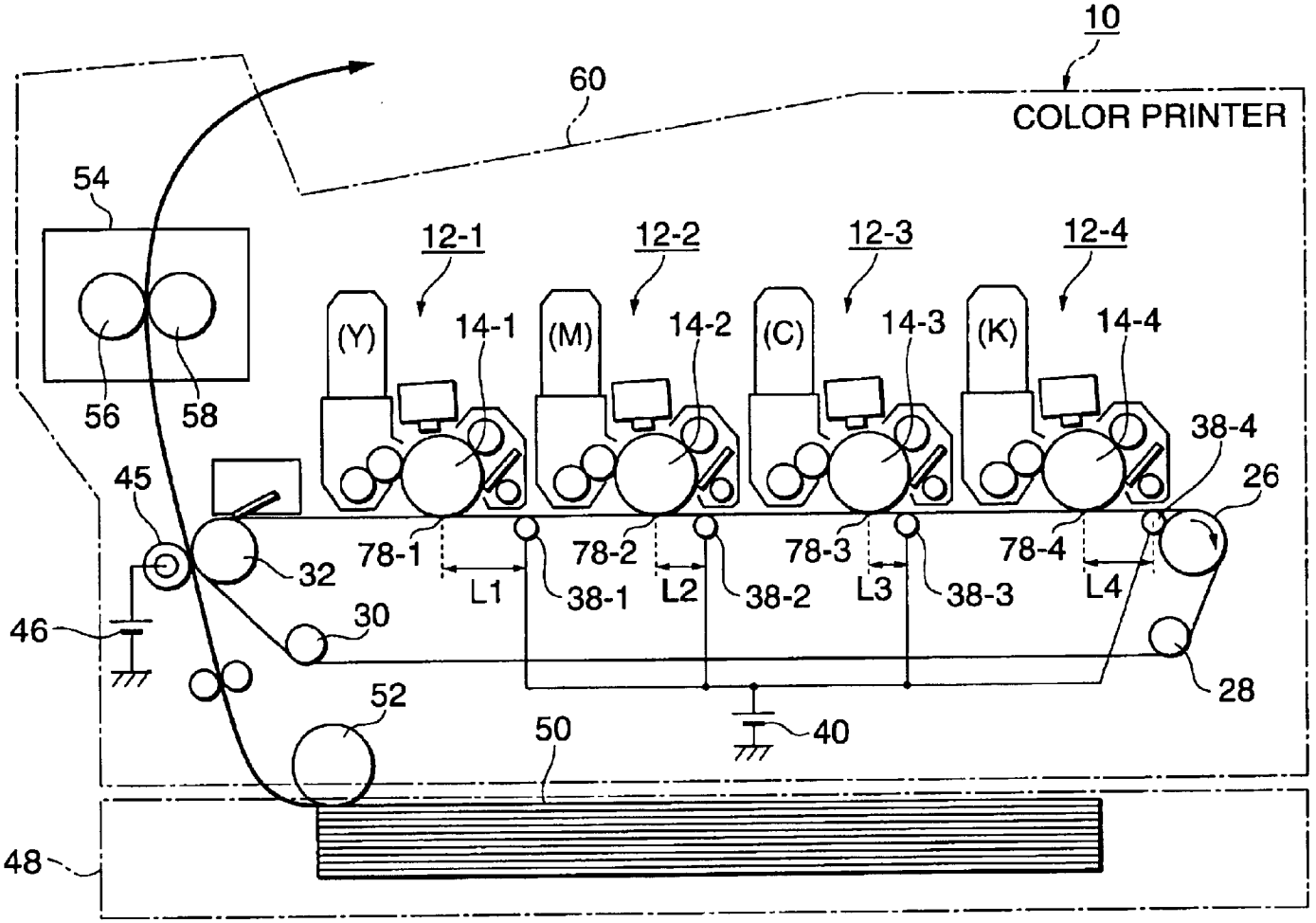
FIG. 31 is a schematic cross-sectional view showing the image forming apparatus according to another embodiment of the present invention in which an optimum effective transfer voltage is set for the transfer nip of the photoconductor drum based on a distance from the transfer roller.

FIG. 31 is a schematic cross-sectional view showing a color printer as the image forming apparatus according to another embodiment of the present invention in which an optimum effective transfer voltage is set for the transfer nip of the photoconductor drum based on a distance from the transfer roller. In this embodiment, stainless-steel rollers having an outer diameter of 80 mm are used as intermediate transfer rollers 80-1 to 80-4. The intermediate transfer rollers 80-1 to 80-4 are provided on the downstream side of the transfer nips, at intervals L1 to L4 between center lines extended from the axes of the photoconductor drums 14-1 to 14-4 and center lines extended from the axes of the intermediate transfer rollers 80-1 to 80-4. The intervals L1 to L4 among the intermediate transfer rollers 80-1 to 80-4 are different within the range of 10 to 45 mm. As 45 mm is approximately a half of the interval between the drums, 90 mm, the intermediate roller is positioned at approximately the center of the interval between the drums. The drum interval is not limited to 90 mm, and it can be set within an appropriate range allowable in accordance with apparatus structure.

Figure 32:
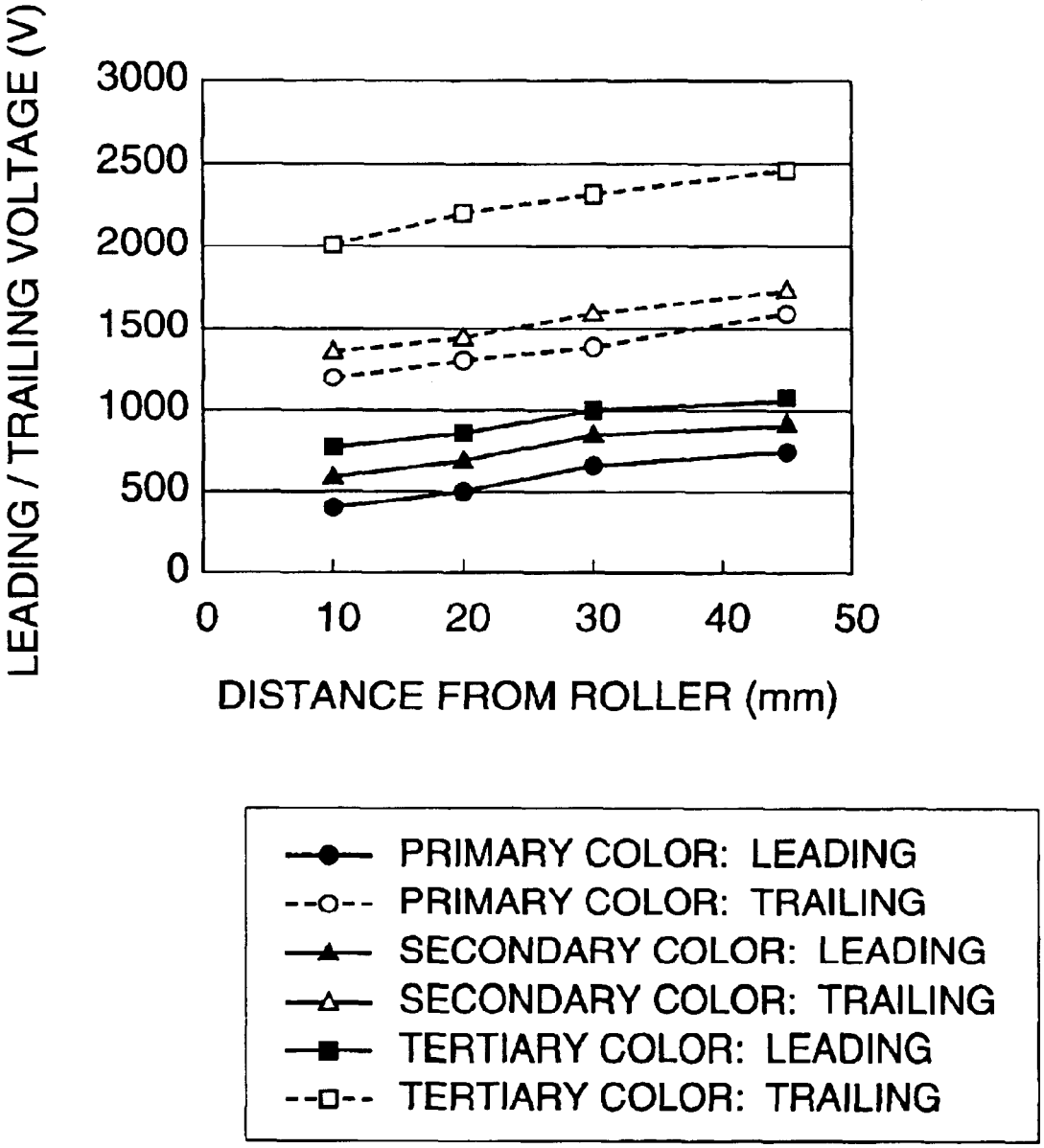
FIG. 32 is a graph showing the characteristics of leading voltages and trailing voltages at 90% transfer efficiency to distance from the roller in FIG. 31.

FIG. 32 shows voltage margins for the excellent transfer efficiency for the primary to tertiary colors in a case where the distances from the intermediate transfer rollers 80-1 to 80-4 to the transfer nips in FIG. 31 are different, i.e., the leading voltages and the trailing voltages in the voltage margins to the roller intervals. As apparent from the characteristics, the respective color voltage margins are shifted to the high-voltage side in accordance with increase in roller interval. In consideration of the characteristics, in the embodiment as shown in FIG. 31, L1=30 mm holds as the yellow interval, L2=20 mm holds as the magenta interval, L3=10 mm holds as the cyan interval, and L4=30 mm holds as the black interval.

Figure 33A:
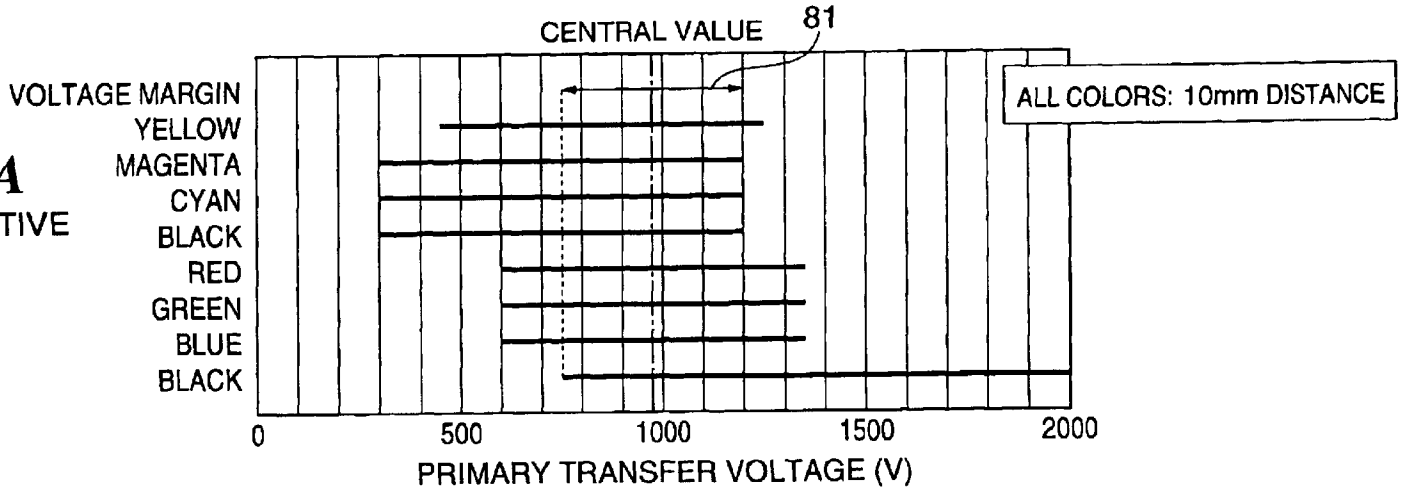
FIGS. 33A and 33B are a graph showing the characteristics of 90% or higher transfer efficiency to the primary transfer voltage in FIG. 31 and a graph of a comparative example.
Figure 33B:
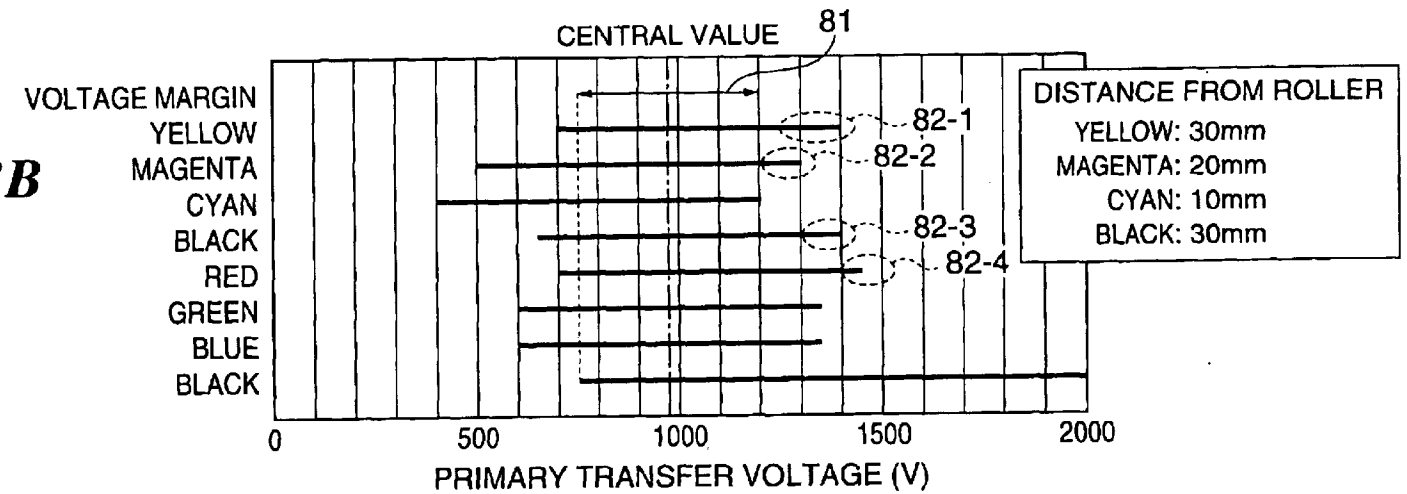

FIGS. 33A and 33B show voltage margins for the primary to tertiary colors to the primary transfer voltage. FIG. 33A is a comparative example where all the intervals between the respective color intermediate transfer rollers and the transfer nips are 10 mm. FIG. 33B is an optimum example where optimum intervals are selected for the respective color intermediate transfer rollers. Also in this case, in the optimum example where the intervals for the respective color intermediate transfer rollers are controlled, portions 82-1 to 82-4 surrounded by a dotted line are expanded to the high-voltage side in the voltage margins for the primary yellow, magenta, the tertiary black and further the secondary red colors. As the intervals L1 to L4 between the intermediate transfer rollers 38-1 to 38-4 and the transfer nips are optimized, the transfer characteristics of the respective colors except the final transfer color can be further stabilized. Note that in the embodiment as shown in FIG. 31, the metal rollers are used as the intermediate transfer rollers 38-1 to 38-4, however, other members such as a conductive brush or sheet can be used. Further, the positions of the intermediate transfer rollers 38-1 to 38-4 are not limited to those on the downstream side of the transfer nips, and the intermediate transfer rollers may be provided on the upstream side or in combination of the upstream and downstream positions.

Note that the above-described embodiments are applications to the color printer as an electrophotographic printing apparatus, however, the present invention is applicable to other appropriate image forming apparatuses such as a copier to perform similar image formation.

As described above, according to the present invention, as optimum ranges are determined for the relative dielectric constant, the surface resistance and the volume resistance of the intermediate transfer belt used in an electrophotographic print process, the belt transfer potential is sufficiently attenuated while the belt moves from a transfer position, and the same transfer voltage can be applied in the next transfer position. In this arrangement, the transfer voltage can be applied from the same power source to the plural color transfer portions. Further, the costs of the transfer power source can be reduced and the apparatus can be downsized.

Further, as the primary transfer voltage to the plural color primary-transfer portions and the secondary transfer voltage used in the secondary transfer after the primary transfer are supplied from the same power source, the costs of the transfer power source can be suppressed and the apparatus can be downsized.

Further, in the case where the single power source is employed for the plural color transfer portions, as the effective transfer voltage applied to the transfer nip of the photoconductor drum is set such that the voltage is increased as the number of overlaid colors is increased, the color-overlay transfer upon application of transfer voltage from the single power source to the plural transfer portions can be stabilized.

What is claimed is:

1. An image forming apparatus comprising:

plural image forming units that form respective color visible images by electrostatically applying different color developers onto respective color image holders;

a belt transfer member, in contact with the respective color image holders, to sequentially overlay-transfer the developers applied on the image holders of the image forming units;

intermediate transfer electrode members, positioned on an opposite side to the image holders of the image forming units, via and in contact with the belt transfer member, that receive application of a primary transfer voltage so as to electrostatically transfer the images from the image forming units onto the belt transfer member; and a paper transfer electrode member, positioned on an opposite side to a backup member, via and in contact with the belt transfer member, that receives application of a secondary transfer voltage so as to transfer the visible images transferred on the belt transfer member onto a print sheet at a time, wherein the primary transfer voltage is applied to the plural intermediate transfer electrode members from one power source.

2. The image forming apparatus according to claim 1, wherein in the belt transfer member, a relative dielectric constant, a surface resistance and a volume resistance are controlled so as to attenuate a potential charged upon initial transfer to ⅓ or lower than the primary transfer voltage before a belt position of the initial transfer arrives at a next transfer position.

3. The image forming apparatus according to claim 2, wherein in the belt transfer member, the relative dielectric constant is 8 or greater, the surface resistance is $1\times10^{9}$ to $1\times10^{11}$ Ω/□ by measurement at 1000 V, the volume resistance is $10^{10}$ Ω·cm or higher by measurement at 100 V and $1\times10^{8}$ to $1\times10^{10}$ Ω·cm by measurement at 500 V.

4. The image forming apparatus according to claim 3, wherein the intermediate transfer electrode member is a transfer roller having a sponge layer on its periphery, and has a resistance of $1\times10^{5}$ to $1\times10^{7}$Ω.

5. An intermediate transfer belt used for primary transfer to electrostatically and sequentially overlay-transfer images of different color developers, formed on plural image holders arrayed in a belt movement direction, onto a belt transfer member, and for secondary transfer to transfer the overlaid images onto a print medium at a time, wherein a relative dielectric constant, a surface resistance and a volume resistance are controlled so as to attenuate a potential charged upon initial primary transfer to ⅓ or lower than the primary transfer voltage before a belt position of the initial primary transfer arrives at a next primary transfer position.

6. The intermediate transfer belt according to claim 5, wherein the relative dielectric constant is 8 or greater, the surface resistance is $1\times10^{9}$ to $1\times10^{11}$ Ω/□ by measurement at 1000 V, the volume resistance is $10^{10}$ Ω·cm or higher by measurement at 100 V and $1\times10^{8}$ to $1\times10^{10}$ Ω·cm by measurement at 500 V.

7. A volume resistance measurement method for intermediate transfer belt used in an image forming apparatus, comprising:

a measurement step of applying an arbitrary transfer voltage to be measured between electrodes in contact with front and rear surfaces of the intermediate transfer belt and measuring an attenuation characteristic of a belt potential to elapsed time from stoppage of application of the transfer voltage; and a calculation step of calculating a volume resistance ρ depending on a change of the belt potential, based on a result of measurement of the attenuation characteristic of the belt potential.

8. The volume resistance measurement method for intermediate transfer belt according to claim 7, wherein at the measurement step, the belt potential is measured by predetermined time Δt from the stoppage of application of the transfer voltage, and wherein at the calculation step, assuming that the belt potential at time $t_n$ is $V(t_n)$; the belt potential at time $t_{n-1}$ previous of the time $t_n$ by the predetermined time $\Delta t$, $V(t_{n-1})$; $\in^*$, a relative dielectric constant; and $\in_0$, a vacuum dielectric constant of $8.854\times10^{-12}$ [F/m], the volume resistance ρ depending on the belt potential $V(t_n)$ is calculated by:

$$\rho[V(t_{n-1})-V(t_n)\}/2]=\Delta t/\{\in^*\in_0(\ln V(t_{n-1})-\ln V(t_n)\}$$

9. An image forming apparatus comprising:

plural image forming units that form respective color visible images by electrostatically applying different color developers onto respective color image holders;

a belt transfer member, in contact with the respective color image holders, to sequentially overlay-transfer the developers applied on the image holders of the image forming units;

intermediate transfer electrode members, positioned on an opposite side to the image holders of the image forming units, via and in contact with the belt transfer member, that receive application of a primary transfer voltage so as to electrostatically transfer the images from the image forming units onto the belt transfer member; and a paper transfer electrode member, positioned on an opposite side to a backup member, via and in contact with the belt transfer member, that receives application of a secondary transfer voltage so as to transfer the visible images transferred on the belt transfer member onto a print sheet at a time, wherein the primary transfer voltage applied to the plural intermediate transfer electrode members and the secondary transfer voltage applied to the paper transfer electrode member are supplied from one power source.

10. The image forming apparatus according to claim 9, wherein the secondary transfer voltage is directly supplied from the power source to the paper transfer electrode member, and wherein the primary transfer voltage, from the power source and lowered via a voltage drop member, is supplied to the plural intermediate transfer electrode members.

11. An image forming apparatus comprising:

plural image forming units that form respective color visible images by electrostatically applying different color developers onto respective color image holders;

a belt transfer member, in contact with the respective color image holders, to sequentially overlay-transfer the developers applied on the image holders of the image forming units;

intermediate transfer electrode members, positioned on an opposite side to the image holders of the image forming units, via and in contact with the belt transfer member, that apply a primary transfer voltage to transfer portions so as to electrostatically transfer the images from the image forming units onto the belt transfer member;

a paper transfer electrode member, positioned on an opposite side to a backup member, via and in contact with the belt transfer member, that receives application of a secondary transfer voltage so as to transfer the visible images transferred on the belt transfer member onto a print sheet at a time; and a primary transfer power source to apply the same primary transfer voltage commonly to the plural intermediate transfer electrode members, wherein resistance values of the plural intermediate transfer electrode members are set to a higher value for a transfer portion in which a number of overlaid colors is smaller and to a lower value for a transfer portion in which a number of overlaid colors is larger.

12. An image forming apparatus comprising:

plural image forming units that form respective color visible images by electrostatically applying different color developers onto respective color image holders;

a belt transfer member, in contact with the respective color image holders, to sequentially overlay-transfer the developers applied on the image holders of the image forming units;

intermediate transfer electrode members, positioned on an opposite side to the image holders of the image forming units, via and in contact with the belt transfer member, that apply a primary transfer voltage to transfer portions so as to electrostatically transfer the images from the image forming units onto the belt transfer member;

a paper transfer electrode member, positioned on an opposite side to a backup member, via and in contact with the belt transfer member, that receives application of a secondary transfer voltage so as to transfer the visible images transferred on the belt transfer member onto a print sheet at a time; and a primary transfer power source to apply the same primary transfer voltage commonly to the plural intermediate transfer electrode members, wherein compensation resistors are provided between the primary transfer power source and the plural intermediate transfer electrode members, and resistance values of the compensation resistors are set to a higher value for a transfer portion in which a number of overlaid colors is smaller and to a lower value for a transfer portion in which a number of overlaid colors is larger.

13. An image forming apparatus comprising:

plural image forming units that form respective color visible images by electrostatically applying different color developers onto respective color image holders;

a belt transfer member, in contact with the respective color image holders, to sequentially overlay-transfer the developers applied on the image holders of the image forming units;

intermediate transfer electrode members, positioned on an opposite side to the image holders of the image forming units, via and in contact with the belt transfer member, that apply a primary transfer voltage to transfer portions so as to electrostatically transfer the images from the image forming units onto the belt transfer member;

a paper transfer electrode member, positioned on an opposite side to a backup member, via and in contact with the belt transfer member, that receives application of a secondary transfer voltage so as to transfer the visible images overlay-transferred on the belt transfer member onto a print sheet at a time; and a primary transfer power source to apply the same primary transfer voltage commonly to the plural intermediate transfer electrode members, wherein the plural intermediate transfer electrode members are conductive members provided in positions away from contact positions between the respective color image holders and the belt transfer member in a belt surface direction, and wherein distances from the contact positions are set to a shorter value in a transfer portion in which a number of overlaid colors is larger and to a longer value for a transfer portion in which a number of overlaid colors is smaller.

* * * * *